US009239547B2

(12) United States Patent
Ueda

(10) Patent No.: US 9,239,547 B2
(45) Date of Patent: Jan. 19, 2016

(54) IMAGE FORMING APPARATUS FOR FORMING IMAGES WITH LIQUID DEVELOPER

(75) Inventor: Hiroyuki Ueda, Osaka (JP)

(73) Assignee: KYOCERA Document Solutions Inc. (JP)

( * ) Notice: Subject to any disclaimer, the term of this patent is extended or adjusted under 35 U.S.C. 154(b) by 282 days.

(21) Appl. No.: 13/472,539

(22) Filed: May 16, 2012

(65) Prior Publication Data

US 2012/0301192 A1 Nov. 29, 2012

(30) Foreign Application Priority Data

May 24, 2011 (JP) ..... 2011-116135

(51) Int. Cl.
*G03G 15/10* (2006.01)
*G03G 15/01* (2006.01)
*G03G 15/00* (2006.01)

(52) U.S. Cl.
CPC ..... *G03G 15/10* (2013.01); *G03G 15/0194* (2013.01); *G03G 15/657* (2013.01)

(58) Field of Classification Search
CPC .. G03G 15/0194; G03G 15/657; G03G 15/10
USPC ..... 399/339
See application file for complete search history.

(56) References Cited

U.S. PATENT DOCUMENTS 3,997,262 A * 12/1976 Doi et al. ..... 399/154
5,030,535 A * 7/1991 Drappel et al. ..... 430/116
5,561,508 A 10/1996 Yagi
6,308,034 B1 * 10/2001 Nakashima et al. ..... 399/249
7,324,779 B2 * 1/2008 Anderson et al. ..... 399/341
7,577,389 B2 * 8/2009 Ishii et al. ..... 399/328
2003/0099894 A1 * 5/2003 Tsubuko et al. ..... 430/116
2004/0126153 A1 7/2004 Koga et al.
2005/0214669 A1 9/2005 Hayashi et al.
2006/0078341 A1 4/2006 Koga et al.
2009/0067904 A1 * 3/2009 Katano et al. ..... 399/339
2012/0034003 A1 * 2/2012 Oda et al. ..... 399/320

FOREIGN PATENT DOCUMENTS

JP 06149084 A * 5/1994
JP 7-84457 3/1995
JP 8-262809 10/1996

OTHER PUBLICATIONS

Wakamatsu. Translation of JP06149084. Published May 1994. Translated Oct. 2015.*

* cited by examiner

*Primary Examiner* — Ryan Walsh
*Assistant Examiner* — Philip Marcus T Fadul
(74) *Attorney, Agent, or Firm* — Gerald E. Hespos; Michael J. Porco; Matthew T. Hespos

(57) ABSTRACT

An image forming apparatus includes a conveyor configured to convey a sheet in a first direction; and an image forming portion which uses liquid developer to form an image on the sheet, wherein the image forming portion includes a first transfer unit, which transfers a first image to the sheet, and a second transfer unit, which transfers a second image after the first transfer unit, the first transfer unit includes a first rubbing unit configured to rub the first image on the sheet, and the second transfer unit includes a second rubbing unit configured to rub the second image on the sheet.

10 Claims, 14 Drawing Sheets

IMAGE FORMING APPARATUS FOR FORMING IMAGES WITH LIQUID DEVELOPER

RELATED APPLICATIONS

This application claims priority to Japanese Patent Application Serial Number 2011-116135, filed on May 24, 2011 by at least one common inventor, and which is incorporated herein by reference in its entirety.

BACKGROUND

1. Technical Field

The disclosure herein relates to an image forming apparatus, which uses liquid developer to form an image on a sheet.

2. Description of the Related Art

An image forming apparatus which uses liquid developer is known as a device for forming an image on a sheet. This type of image forming apparatuses typically has a fixing device configured to fix images onto sheets. The fixing device generates relatively high heat in order to melt toner contained in the liquid developer, which is transferred onto the sheet.

It is not necessary for a fixing device to generate heat if the fixing device uses liquid developer which has characteristics such that its components (carrier solution) permeate into a sheet and high-molecular compounds with dispersed pigment therein deposit on the surface of the sheet. However, the present inventors have discovered disadvantageous properties which are likely to cause peel-off of the image formed on the sheet by means of such liquid developer.

An object of the disclosure is to provide an image forming apparatus which prevents an image from peeling off from a sheet.

SUMMARY

An image forming apparatus according to one aspect of the disclosure has a conveyor configured to convey a sheet in a first direction; and an image forming portion which uses liquid developer to form an image on the sheet, wherein the image forming portion includes a first transfer unit, which transfers a first image to the sheet, and a second transfer unit, which transfers a second image after the first transfer unit, the first transfer unit includes a first rubbing unit configured to rub the first image on the sheet, and the second transfer unit includes a second rubbing unit configured to rub the second image on the sheet.

DETAILED DESCRIPTION

Image forming apparatuses according to various embodiments are described hereinafter with reference to the accompanying drawings. Directional terms used hereinafter such as "upper/above," "lower/below," "left," and "right" are merely to clarify description about the embodiments and do not limit principles of the image forming apparatuses.

(First Embodiment)

<Fixation Methodologies>

Figure 1A:
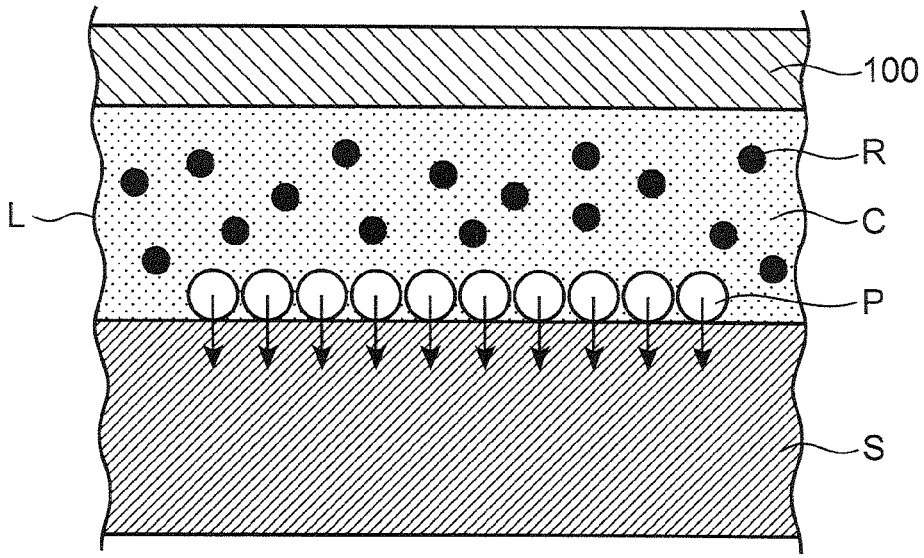
FIG. 1A is a schematic view showing a transfer process using liquid developer.
Figure 1B:
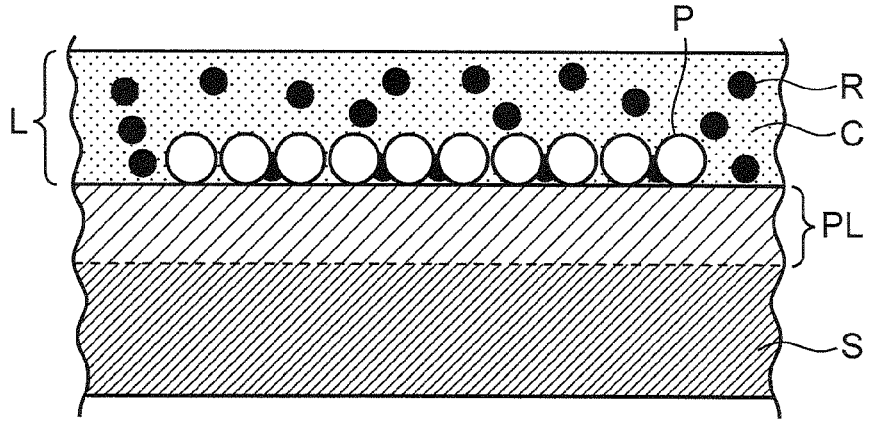
FIG. 1B is a schematic view showing the transfer process using the liquid developer.
Figure 1C:
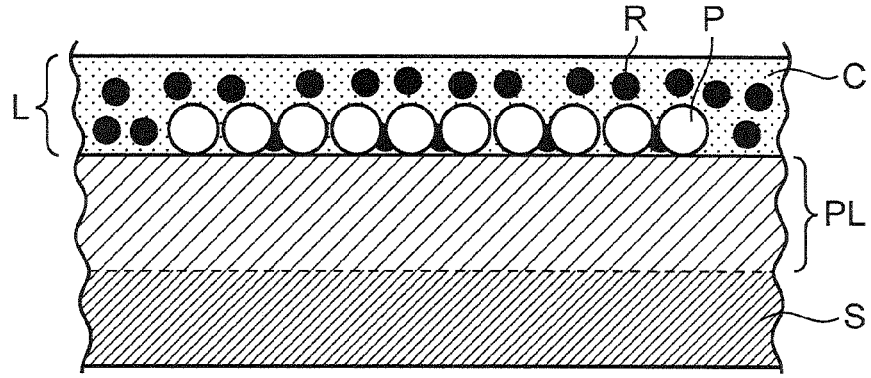
FIG. 1C is a schematic view showing the transfer process using the liquid developer.

FIGS. 1A to 1C schematically show a transfer process for transferring an image obtained by means of liquid developer, respectively. The transfer process is sequentially performed in the order of FIGS. 1A to 1C. The image transfer to a sheet and the image obtained after the transfer are described with reference to FIGS. 1A to 1C.

FIG. 1A is a schematic cross-sectional view showing a liquid layer L of liquid developer, which forms an image transferred from an image carrier 100 to a sheet S. For example, the image carrier 100 may be a transfer roller equipped in an image forming apparatus (e.g., a printer, copier, facsimile device, or complex machine with their functions), which uses the liquid developer to form the image. The image carrier 100 conveys the liquid layer L of the liquid developer, which is used for forming the image, to a transfer position to which the sheet S is transferred.

The sheet S comes into contact with the liquid layer L on the image carrier 100 at the transfer position. The liquid layer L of the liquid developer, which is used for forming the image, includes carrier liquid C, colored particles P for coloring an image, and polymer compounds R dissolved or swollen in the carrier liquid C. The colored particles P, which are dispersed in the carrier liquid C, are electrostatically attracted to the sheet S. Thus, the colored particles P adhere to the sheet S and form the image. For example, the attraction of the colored particles P to the sheet S is accomplished by an electric field across the sheet S.

FIG. 1B schematically shows the carrier liquid C permeating into the sheet S. The carrier liquid C with a relatively low kinetic viscosity permeates into the sheet S to form a permeation layer PL in a surface layer of the sheet S. The polymer compounds R in the liquid layer L of the liquid developer become more concentrated as the carrier liquid C permeates into the sheet S.

As shown in FIG. 1C, when the carrier liquid C further permeates into the sheet S, the polymer compounds R of the liquid layer L deposit on the surface of the sheet S. As described above, the colored particles P electrostatically adhere to the sheet S before the deposition of the polymer compounds R. Therefore, the polymer compounds R depositing on the surface of the sheet S form a coating layer, which is laminated on the layer of the colored particles P that forms the image on the sheet S.

Figure 2A:
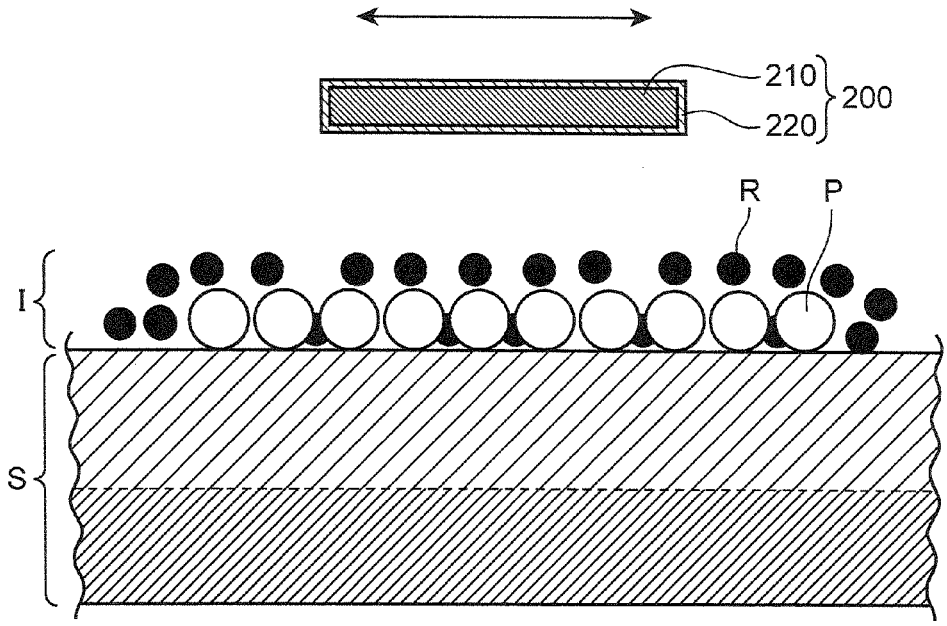
FIG. 2A is a schematic view showing methodologies of a fixation process after the transfer process shown in FIGS. 1A to 1C.
Figure 2B:
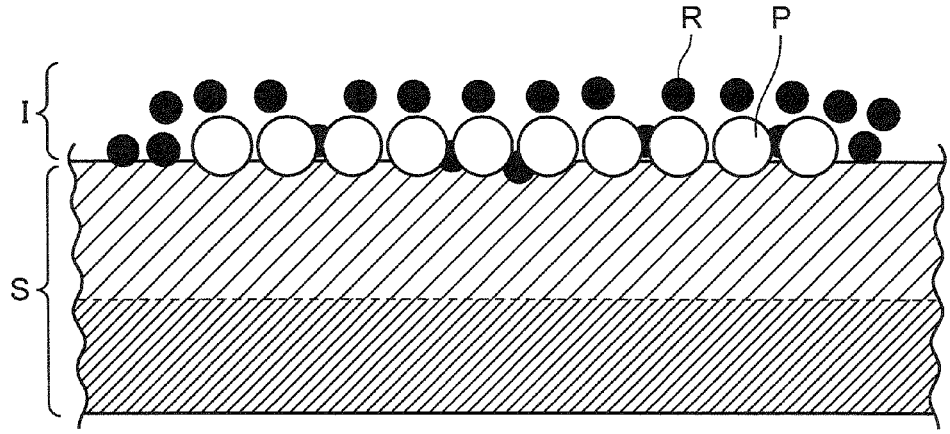
FIG. 2B is a schematic view showing the methodologies of the fixation process performed after the transfer process shown in FIGS. 1A to 1C.

FIGS. 2A and 2B schematically show a fixation process performed after the transfer process. FIG. 2A schematically shows the fixation process. FIG. 2B is a schematic cross-sectional view of the sheet S obtained after the fixation process. Methodologies of the fixation process are described with reference to FIGS. 1A to 2B.

After the transfer process, the carrier liquid C substantially permeates into the sheet S, so that an image layer I with the polymer compounds R and the colored particles P is formed on the sheet S. In the transfer process, the image layer I is not applied with any physical force except for a pressure and electric field generated during transferring the liquid layer L (image) from the image carrier 100 to the sheet S. Therefore, before the fixation process, a physical bond between the image layer I and the sheet S is relatively weak, so that the image layer I may be peeled off as a result of a peel test using a tape described hereinafter.

FIG. 2A shows a rubbing plate 200. For example, the rubbing plate 200 has a substantially rectangular board 210, and a nonwoven fabric 220 covering the surface of the board 210. In the present embodiment, a polypropylene nonwoven fabric is used as the nonwoven fabric 220. Alternatively, a polytetrafluoroethylene (PTFE) nonwoven fabric having a dynamic friction coefficient of 0.10 (referred to as "PTFE felt A," hereinafter), a polytetrafluoroethylene (PTFE) nonwoven fabric having a dynamic friction coefficient of 0.13 (referred to as "PTFE felt B," hereinafter), a polyester felt, a polyethylene terephthalate felt (referred to as "PET felt," hereinafter), a polyamide felt, or a wool felt, may be used as the nonwoven fabric 220.

The rubbing plate 200 placed on the image layer I on the sheet S moves over the image layer I along the upper surface of the sheet S. As a result, a part of the components of the image layer I (the colored particles P and/or the polymer compounds R) engages into the surface layer of the sheet S (anchor effect), as shown in FIG. 2B. This reinforces a physical bond between the image layer I and the sheet S.

As described above, the upper surface of the image layer I is covered with the polymer compounds R. Thus, the colored particles P for coloring the image are appropriately protected by the polymer compounds R from the rubbing operation of the rubbing plate 200. Thus, the image is less likely to be damaged by the rubbing operation of the rubbing plate 200.

<Experiment>

Figure 3:
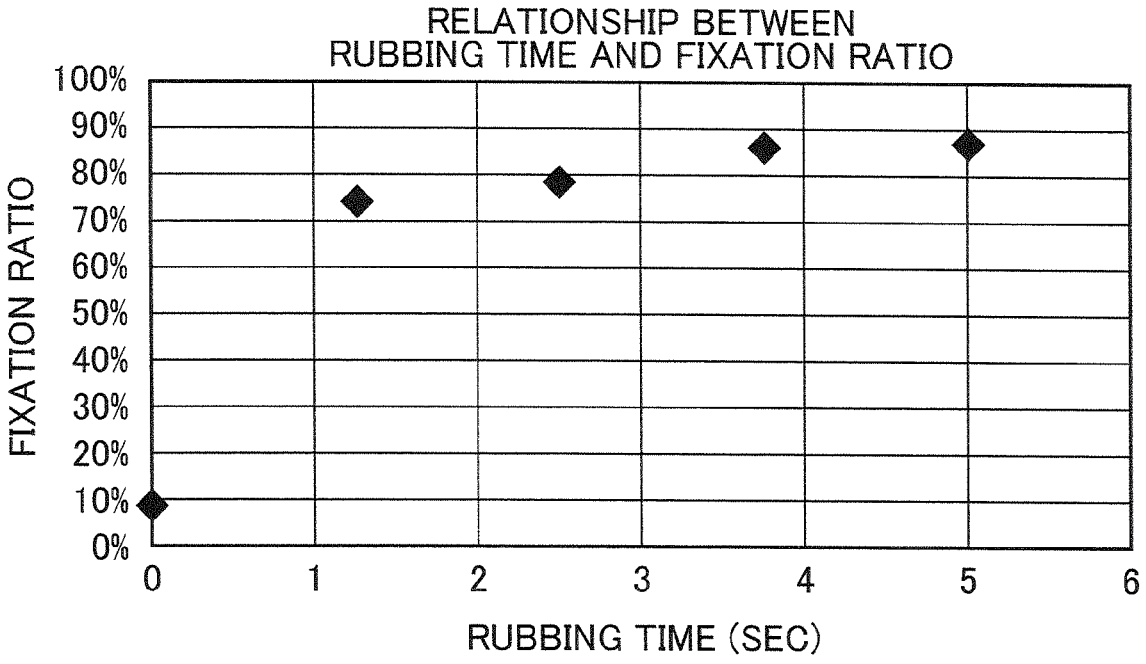
FIG. 3 is a graph schematically showing a relationship between a rubbing time and fixation ratio.

FIG. 3 is a graph schematically showing a fixation ratio of the image layer I against a time period (rubbing time), during which the rubbing plate 200 slides on the image layer I. The relationship between the rubbing time and the fixation ratio is described with reference to FIGS. 2A to 3.

The rubbing time shown on the horizontal axis of the graph shown in FIG. 3 indicates a time length during which a given region on the image layer I is in contact with the reciprocating rubbing plate 200.

A fixation ratio FR shown on the vertical axis of the graph shown in FIG. 3 is calculated from the following formula, where $D_0$ represents a density of the image obtained before peeling a tape attached to the image layer I, and $D_1$ represents a density of the image obtained after peeling the tape attached to the image layer I.

$$FR\ (\%)=D_1/D_0\times 100 \qquad \text{[Formula 1]}$$

The tape used for evaluating the fixation ratio FR was Mending Tape produced by 3M. The Mending Tape was attached onto the image layer I by means of a dedicated tool. Therefore, attachment strengths between the image layer I in a test sample and the Mending Tape are kept substantially constant among data points shown in the graph of FIG. 3. The Mending Tape was pressed to the image layer I of the test sample, and then was peeled off from the image layer I by means of a dedicated tool at a substantially constant peeling angle and substantially constant peeling speed.

The image density of the test sample was measured by SpectroEye, which is a spectrophotometer produced by Sakata Inx Eng. Co., Ltd.

As shown in FIG. 3, if the image layer I is rubbed for one second or longer, the image layer I may achieve a relatively high fixation ratio FR. Rubbing the image layer I for less than one second indicates a drastic increase in the fixation ratio FR of the image layer I. It should be noted that a weight of the rubbing plate 200 is appropriately defined such that the surface of the image layer I is damaged.

Figure 4:
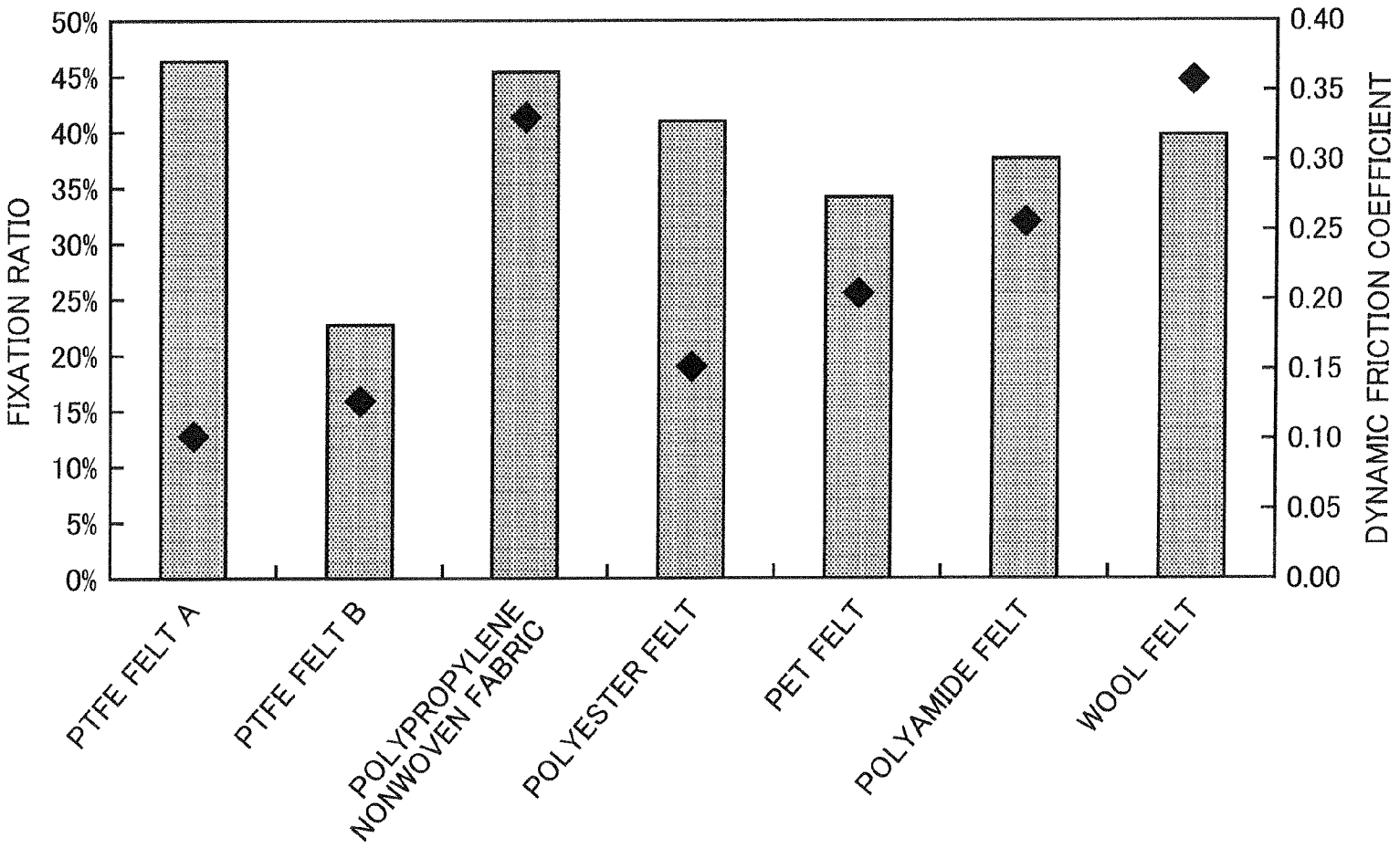
FIG. 4 is a graph schematically showing a result of a screening test performed on various nonwoven fabrics.

FIG. 4 is a graph schematically showing relationships of various nonwoven fabrics 220 to the fixation ratios FR. The relationship between the nonwoven fabrics 220 and the fixation ratios FR is described with reference to FIGS. 2A to 4.

The horizontal axis of FIG. 4 represents types of nonwoven fabrics 220. The PTFE felt A, PTFE felt B, polypropylene nonwoven fabric, polyester felt, PET felt, polyamide felt, and wool felt are used in this test.

The left vertical axis of FIG. 4 represents the abovementioned fixation ratios FR. The fixation ratios FR are expressed by bar graphs in FIG. 4. It should be noted that all types of the nonwoven fabrics 220 used in this test achieved relatively high fixation ratios FR in a longer rubbing time than one second. Therefore, the fixation ratios FR shown in FIG. 4 are calculated on the basis of a rubbing time of 0.625 seconds in order to screen out relatively effective types of nonwoven fabrics 220.

The right vertical axis of FIG. 4 represents a dynamic friction coefficient of each nonwoven fabric 220 shown by a dot in FIG. 4. Lower dynamic friction coefficients are advantageous because of less impingement on conveyance of the sheet S and less damage to the image layer I.

As shown in FIG. 4, the PTFE felt A achieves the lowest dynamic friction coefficient and the highest fixation ratio FR. It is, therefore, clear that the PTFE felt A is the most advantageous among the tested nonwoven fabrics 220. Any nonwoven fabric material, which is not shown in FIG. 4, may be used as the nonwoven fabric 220. Preferably, a nonwoven fabric material with a dynamic friction coefficient of 0.50 or lower is used as the nonwoven fabric 220. It is less likely that such a nonwoven fabric material with a dynamic friction coefficient of 0.50 or lower may impinge on the conveyance of the sheet S and damage to the image layer I.

<Image Forming Apparatus>

The fixation methodologies described with reference to FIGS. 1A to 4 are suitably applied to the fixation process performed by printers, copiers, facsimile devices, complex machines with their functions, and other apparatuses configured to form an image on the sheets S.

Figure 5:
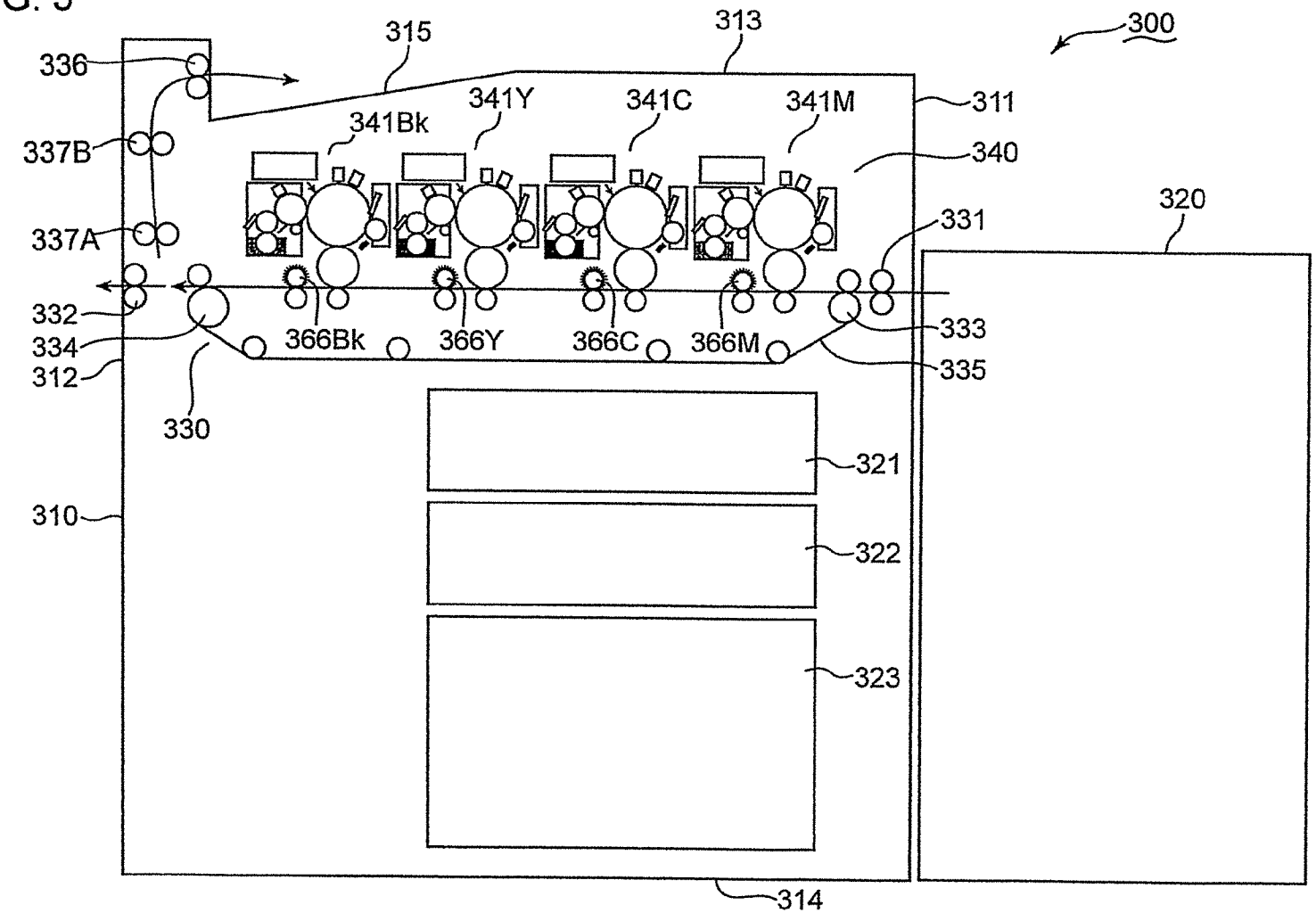
FIG. 5 is a schematic view of a color printer exemplified as an image forming apparatus according to the first embodiment.

FIG. 5 is a schematic view of a color printer exemplified as an image forming apparatus according to the present embodiment. The color printer is described with reference to FIG. 5.

A color printer 300 has a housing 310 which stores various devices for forming an image on a sheet, and a sheet feeder 320 adjacent to the housing 310. The color printer 300 further has cassettes 321 to 323, which are stored in the housing 310. Sheets are stored in the sheet feeder 320 and each of the cassettes 321 to 323. A user operates a personal computer (not shown) electrically connected to the color printer or an operation panel (not shown) of the color printer 300 to select one of the sheet feeder 320 and the cassettes 321 to 323 as a sheet feeding source. In the following description, the sheet feeder 320 is selected as the sheet feeding source. Any known device configured to store and send sheets may be used as a structure of the sheet feeder 320 and the cassettes 321 to 323.

The housing 310 includes a right wall 311 adjacent to the sheet feeder 320, a left wall 312 opposite to the right wall 311, a top wall 313, which forms the upper surface of the housing 310 between the right and left walls 311, 312, and a bottom wall 314 opposite to the top wall 313. The color printer 300 further has a resist roller pair 331, which is situated near the right wall 311, a first discharge roller pair 332, which is situated near the left wall 312, and a conveying device 330, which is situated between the resist roller pair 331 and the first discharge roller pair 332. The sheet feeder 320 sends a sheet toward the resist roller pair 331. Subsequently, the resist roller pair 331 sends the sheet to the conveying device 330.

The conveying device 330 includes a right roller 333, which is situated near the resist roller pair 331, a left roller 334, which is situated near the first discharge roller pair 332, and a conveying belt 335 (endless belt), which extends between the right and left rollers 333, 334. The right and left rollers 333, 334 rotate so that the upper surface of the conveying belt 335 moves leftward. The sheet sent by the resist roller pair 331 is placed on the upper surface of the conveying belt 335, and then conveyed toward the first discharge roller pair 332. An image is formed on the sheet conveyed by the conveying belt 335. The sheet reaching the first discharge roller pair 332 is discharged through the left wall 312. In the present embodiment, the conveying device 330 is exemplified as the conveyor. The conveyance direction, in which the sheet is conveyed leftward, is exemplified as the first direction.

The top wall 313 includes an inclined surface 315 on which the sheets after the image formation may be stacked. The color printer 300 further includes a second discharge roller pair 336, which discharges a sheet toward the inclined surface 315, and conveying roller pairs 337A, 337B, which are arranged along a path extending from the outlet of the conveying device 330 to the second discharge roller pair 336. A user may operate the personal computer (not shown) electrically connected to the color printer 300 or the operation panel (not shown) of the color printer 300 to determine the first or second discharge roller pair 332, 336 as a discharge device. Therefore, after the image forming process on the conveying device 330, the sheet is discharged from the housing 310 by the first or second discharge roller pair 332, 336.

The color printer 300 further has an image forming portion 340, which uses the liquid developer to form an image on a sheet. The image forming portion 340 includes an image forming unit 341M, which forms a magenta image, an image forming unit 341C, which forms a cyan image, an image forming unit 341Y, which forms a yellow image, and an image forming unit 341Bk, which forms a black image. The image forming units 341M, 341C, 341Y, and 341Bk on the conveying device 330 are arranged in a direction from the right roller 333 to the left roller 334. Therefore, the magenta image, cyan image, yellow image, and black image are sequentially formed on a sheet. The magenta image, cyan image, yellow image, and black image are superimposed on each other over the sheet. As a result, a full-color image is formed on the sheet. In the present embodiment, one of the magenta, cyan, and yellow images is exemplified as the first image. An image, which is formed on the sheet after the image exemplified as the first image, is exemplified as the second image. For example, if the magenta image is exemplified as the first image, one of the cyan, yellow and black images is exemplified as the second image.

Figure 6:
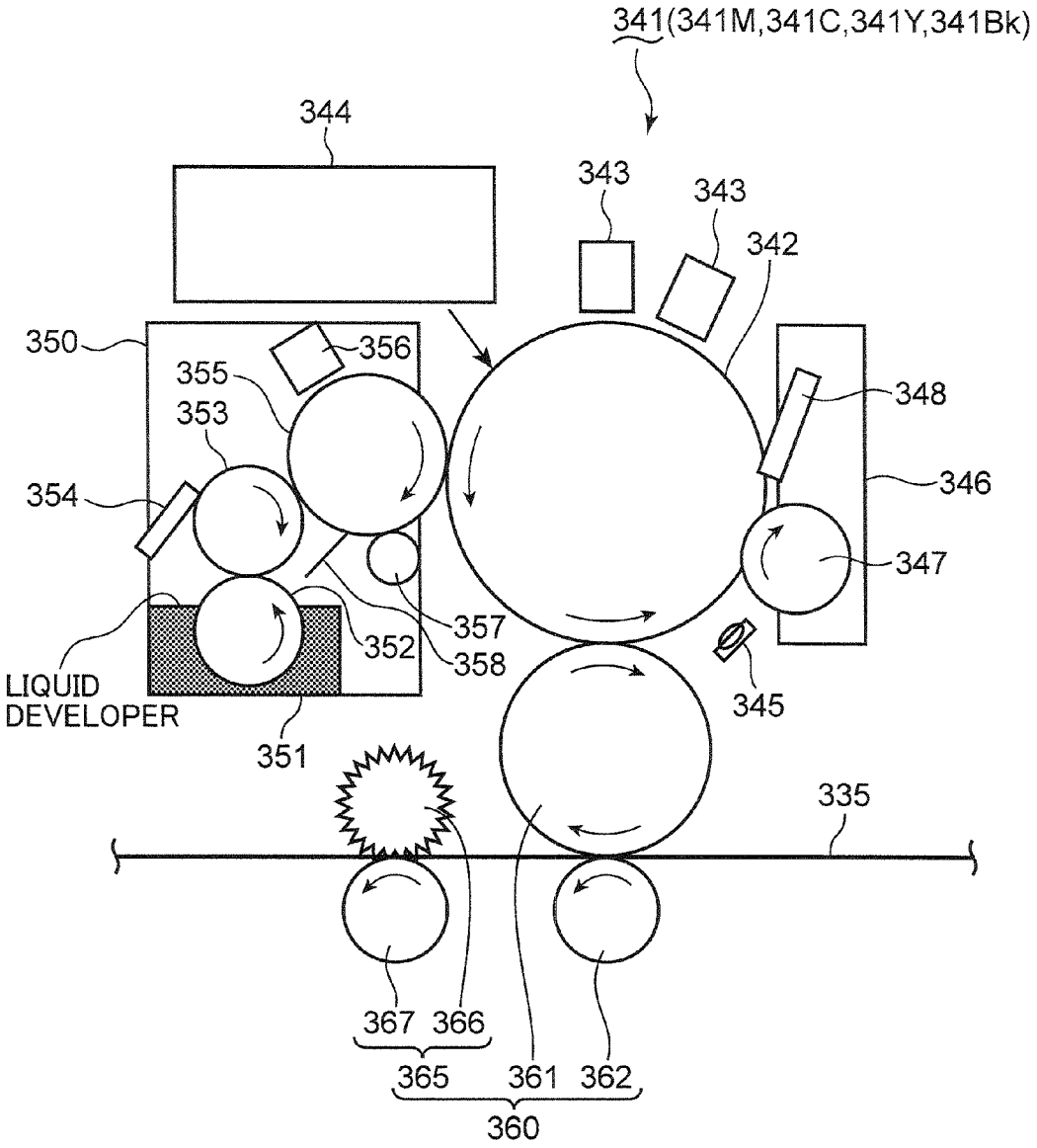
FIG. 6 is a schematic view showing an image forming unit of the color printer shown in FIG. 5.

FIG. 6 is a schematic view of an image forming unit. The image forming unit is described with reference to FIG. 6.

An image forming unit 341 shown in FIG. 6 represents one of the image forming units 341M, 341C, 341Y and 341Bk shown in FIG. 5. Therefore, the description about a structure of the image forming unit 341 shown in FIG. 6 is applied to each of the image forming units 341M, 341C, 341Y, and 341Bk shown in FIG. 5.

The image forming unit 341 has a photosensitive drum 342, a first charger 343, which uniformly charges the circumferential surface of the photosensitive drum 342, and an exposure device 344, which irradiates the circumferential surface of the photosensitive drum 342 with a laser beam. For example, the exposure device 344 emits the laser beam in response to the image data on the circumferential surface of the photosensitive drum 342, which is charged by the first charger 343 if a user outputs image data from the personal computer (not shown). As a result, an electrostatic latent image is formed on the circumferential surface of the photosensitive drum 342.

The image forming unit 341 has a developing device 350, which applies the liquid developer to the circumferential surface of the photosensitive drum 342. The developing device 350 has a reservoir 351, which stores the liquid developer, a dipped roller 352, which is partially soaked in the liquid developer in the reservoir 351, and a feed roller 353 above the dipped roller 352. The dipped roller 352 rotates in the liquid developer to flow up the liquid developer of the reservoir 351. The liquid developer is flown up onto the circumferential surface of the dipped roller 352 and moves toward the feed roller 353. The liquid developer is then placed on the circumferential surface of the feed roller 353, which is situated nearby the dipped roller 352.

The developing device 350 further has a doctor blade 354, which has an edge nearby the circumferential surface of the feed roller 353, and a developing roller 355, which is situated between the photosensitive drum 342 and the feed roller 353. The doctor blade 354 makes a substantially consistent thickness of the liquid developer layer on the circumferential surface of the feed roller 353. Subsequently, the liquid developer is placed on the circumferential surface of the developing roller 355. Consequently, a substantially constant amount of the liquid developer is fed to the developing roller 355.

The developing device 350 further has a second charger 356. The second charger 356 charges toner of the liquid developer in order to make the toner of the liquid developer appropriately move to the photosensitive drum 342. Thereafter, the liquid developer moves toward the photosensitive drum 342 to reach the circumferential surface of the photosensitive drum 342 as the developing roller 355 rotates. As a result, the image is formed on the circumferential surface of the photosensitive drum 342. In the present embodiment, the circumferential surface of the photosensitive drum 342 is exemplified as the formation surface. The photosensitive drum 342 is exemplified as the image forming element.

The developing device 350 further has a cleaning roller 357 and cleaning blade 358. After the application of the liquid developer to the photosensitive drum 342, the cleaning roller 357 and the cleaning blade 358 remove residual liquid developer on the circumferential surface of the developing roller 355.

The image forming unit 341 further has a transfer unit 360, which transfers the image to a sheet on the conveying belt 335. In the present embodiment, the transfer unit 360, which transfers the image exemplified as the first image to the sheet, is exemplified as the first transfer unit. The transfer unit 360, which transfers the image exemplified as the second image to the sheet, is exemplified as the second transfer unit.

The transfer unit 360 has an intermediate transfer roller 361, which is situated between the conveying belt 335 and the photosensitive drum 342, and a backup roller 362, which is situated below the intermediate transfer roller 361. The conveying belt 335 intervenes between the backup roller 362 and the intermediate transfer roller 361.

An image formed on the circumferential surface of the photosensitive drum 342 moves toward the intermediate transfer roller 361 as the photosensitive drum 342 rotates. Thereafter, the image is placed on the circumferential surface of the intermediate transfer roller 361. While the sheet on the conveying belt 335 passes between the intermediate transfer roller 361 and the backup roller 362, the image on the intermediate transfer roller 361 moves onto the sheet. Thus, the intermediate transfer roller 361 may deliver the image from the photosensitive drum 342 to the sheet on the conveying belt 335. The intermediate transfer roller 361 corresponds to the image carrier 100 described with reference to FIGS. 1A to 1C. In the present embodiment, the intermediate transfer roller 361 is exemplified as the relay element.

The transfer unit 360 further has a rubbing unit 365 configured to rub an image placed onto the sheet. In the present embodiment, the rubbing unit 365, which rubs an image exemplified as the first image, is exemplified as the first rubbing unit. The rubbing unit 365, which rubs an image exemplified as the second image, is exemplified as the second rubbing unit.

The rubbing unit 365 includes a rubbing roller 366, which rubs the image on the sheet, and a holding roller 367, which is situated below the rubbing roller 366. The holding roller 367 stably holds the conveying belt 335 and a sheet on the conveying belt 335 while the rubbing roller 366 rubs the image. For example, the circumferential surface of the rubbing roller 366 may be at least partially covered with at least one nonwoven fabric selected from a group of the various nonwoven fabrics described with reference to FIG. 4. Alternatively, a brush, which rubs an image on the sheet, may be at least partially attached onto the circumferential surface of the rubbing roller 366. The rubbing roller 366 corresponds to the rubbing plate 200 described with reference to FIGS. 1A to 1C. Because the circumferential surface of the rubbing roller 366 rubs the image on the sheet in accordance with the aforementioned fixation methodologies, the image may be appropriately fixed onto the sheet. In the present embodiment, the rubbing roller 366 is exemplified as the rubbing element. The rubbing roller 366 of the rubbing unit 365, which is exemplified as the first rubbing unit, is exemplified as the first rubbing element. The rubbing roller 366 of the rubbing unit 365, which is exemplified as the second rubbing unit, is exemplified as the second rubbing element. The operation of the rubbing unit 365 is further described hereinafter.

The image forming unit 341 further has a neutralization device 345, which neutralizes the circumferential surface of the photosensitive drum 342 after the image transfer to the intermediate transfer roller 361, and a cleaning device 346, which removes residual liquid developer on the circumferential surface of the photosensitive drum 342 after the neutralization process. The cleaning device 346 includes a cleaning roller 347 and cleaning blade 348. The cleaning roller 347 and the cleaning blade 348 appropriately remove the residual liquid developer on the circumferential surface of the photosensitive drum 342.

Figure 7:
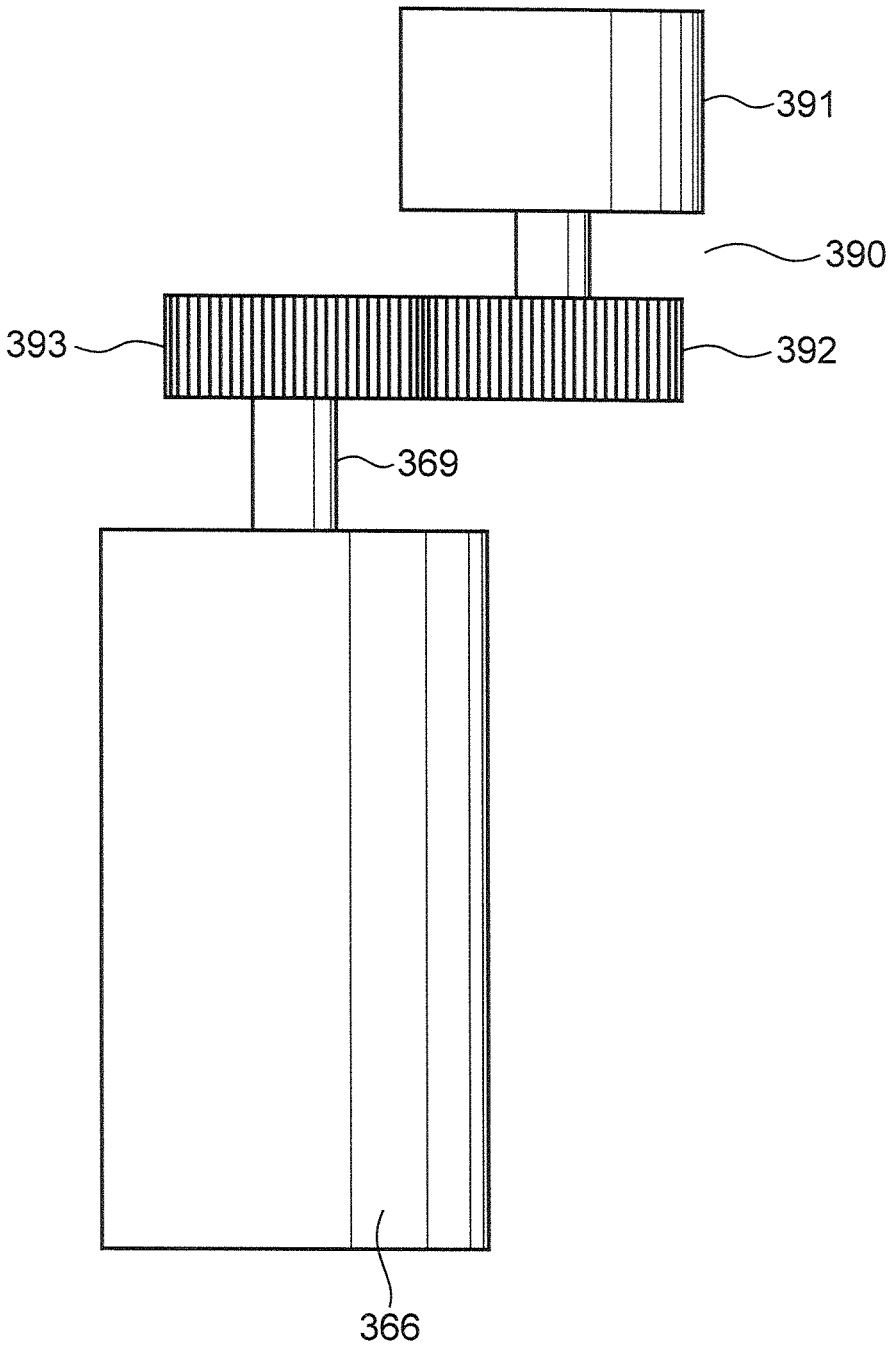
FIG. 7 is a schematic view showing a drive mechanism, which drives a rubbing roller of the image forming unit shown in FIG. 6.

FIG. 7 is a schematic view showing a drive mechanism for driving the rubbing roller 366. The drive for the rubbing roller 366 is further described with reference to FIGS. 6 and 7.

The image forming unit 341 further has a drive mechanism 390 configured to drive the rubbing roller 366. The drive mechanism 390 includes a drive motor 391, which generates a drive force to rotate the rubbing roller 366, a first gear 392, which transmits the drive force of the drive motor 391, and a second gear 393, which is attached to a journal 369 of the rubbing roller 366. The drive force is transmitted from the first gear 392, which is attached to a rotational shaft of the drive motor 391, to the second gear 393, which engages with the first gear 392. As a result, the rubbing roller 366 rotates. The rotating speed of the rubbing roller 366 is appropriately adjusted in accordance with a rotating speed setting of the drive motor 391.

Figure 8:
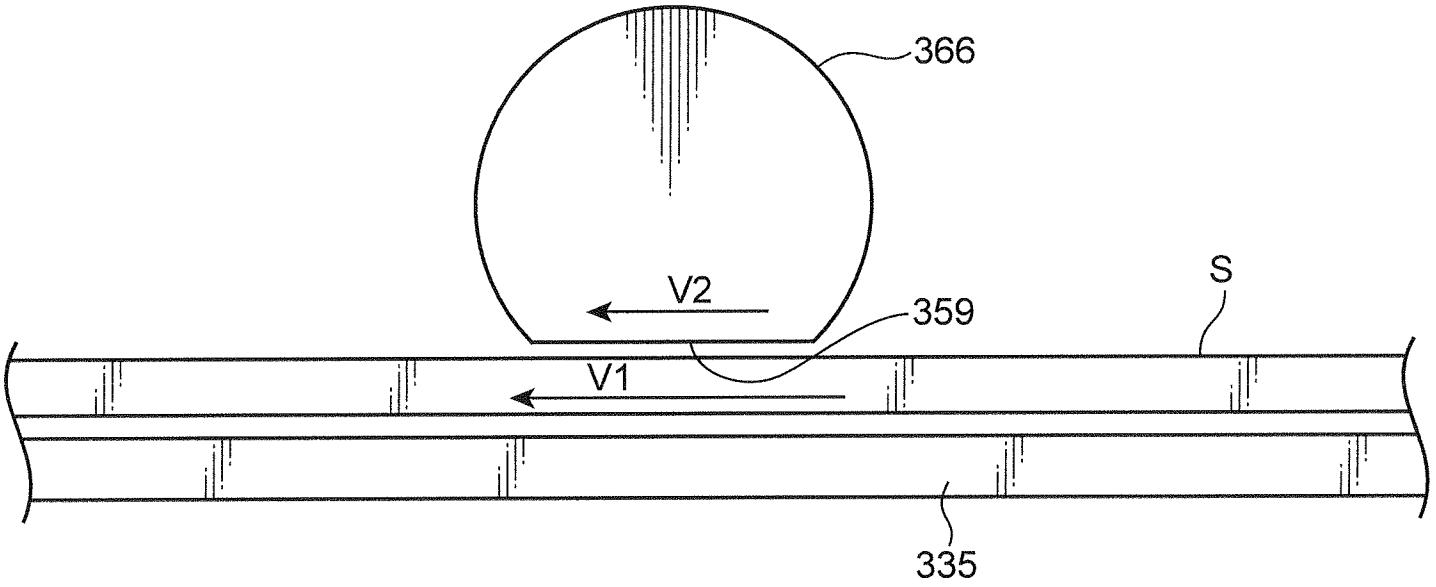
FIG. 8 is a schematic view of the rubbing roller shown in FIG. 7.

FIG. 8 schematically shows the rubbing roller 366, which rubs an image on the sheet S. The operation of the rubbing roller 366 is described with reference to FIGS. 6 to 8.

When the rubbing roller 366 is pressed against the sheet S on the conveying belt 335, a substantially flat contact surface 359 coming into contact with the image on the sheet S is formed on the circumferential surface of the rubbing roller 366. While the conveying belt 335 conveys the sheet S at a first speed V1, the rubbing roller 366 rotates so that the contact surface 359 moves leftward at a second speed V2. The second speed V2 may be set to be lower than the first speed V1. Alternatively, the second speed V2 may be set to be higher than the first speed V1. The second speed V2 may be set by adjusting the rotating speed of the drive motor 391. If the second speed V2 is different from the first speed V1, the image on the sheet S may be appropriately rubbed in accordance with a relative speed between the rubbing roller 366 and the sheet S.

Figure 9:
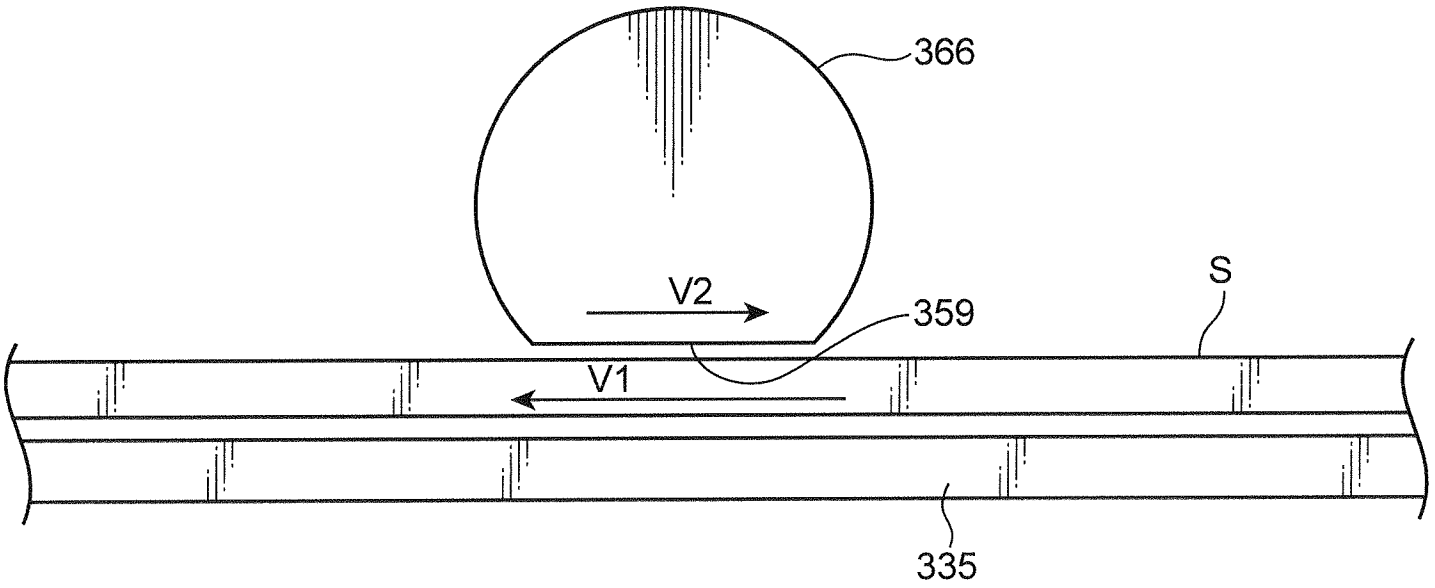
FIG. 9 is a schematic view of the rubbing roller shown in FIG. 7.

FIG. 9 schematically shows the rubbing roller 366 which rubs an image on the sheet S. Other operation of the rubbing roller 366 is described with reference to FIGS. 6, 7 and 9.

The drive motor 391 may rotate the rubbing roller 366 so that the contact surface 359 moves in a different direction from the conveyance direction of the sheet S. In FIG. 9, the contact surface 359 moves rightward. As a result, the image on the sheet S is appropriately rubbed. The second speed V2 may be set to any value if the movement direction of the contact surface 359 is different from the movement direction of the sheet S. In the present embodiment, the movement direction of the contact surface 359 shown in FIG. 9 (to the right) is exemplified as the second direction.

Figure 10:
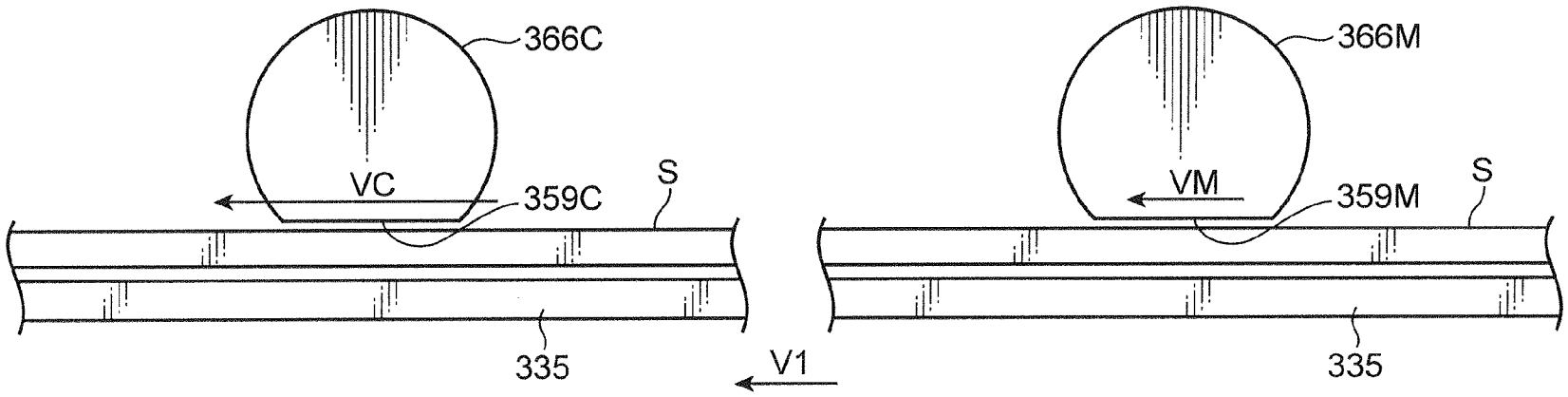
FIG. 10 is a schematic view of rubbing rollers of the color printer shown in FIG. 5.

FIG. 10 schematically shows the rubbing roller 366, which rubs an image on the sheet S. Other operation of the rubbing roller 366 is described with reference to FIGS. 5 to 7 and FIG. 10.

FIG. 10 shows a rubbing roller 366M of the image forming unit 341M and a rubbing roller 366C of the image forming unit 341C. The rubbing rollers 366M and 366C may be rotated by the drive mechanism 390 described with reference to FIG. 7.

Contact surfaces 359M and 359C are formed on circumferential surfaces of the rubbing rollers 366M and 366C, respectively. The contact surfaces 359M and 359C may move rightward at a higher speed than the moving speed of the sheet S (the first speed V1). In FIG. 10, the speed of the contact surface 359M is shown as the vector "VM." The speed of the contact surface 359C is shown as the vector "VC."

The contact surface 359C rubs not only the cyan image on the sheet S but also the magenta image formed before the formation of the cyan image. The contact surface 359C rubs a relatively large amount of the liquid developer. As shown in FIG. 10, the speed VC of the contact surface 359C is set to be higher than the speed VM of the contact surface 359M. As a result, the contact surface 359C may appropriately rub the image, which is formed by the increased liquid developer.

FIG. 5 shows a rubbing roller 366Y of the image forming unit 341Y and a rubbing roller 366Bk of the image forming unit 341Bk, in addition to the aforementioned rubbing rollers 366M and 366C. If the rubbing rollers 366M, 366C, 366Y and 366Bk is substantially the same in diameter, the drive mechanism 390 described with reference to FIG. 7 may make the rotating speed of the rubbing roller 366Y higher than the rotating speed of the rubbing roller 366C and make the rotating speed of the rubbing roller 366Bk higher than the rotating speed of the rubbing roller 366Y. As a result, a rubbing amount for the liquid developer is increased as a liquid developer amount increases on the sheet S. Thus, the image is appropriately fixed to the sheet S.

The principles described with reference to FIG. 10 are also applicable if the movement directions of the contact surfaces 359M and 359C are different from the movement direction of the sheet S. Appropriate image fixation is achieved on the basis of the principles described with reference to FIG. 10 as long as a relative speed of a rubbing roller of a downstream image forming units with respect to the sheet speed are set to be higher than a relative speed between the sheet and an upstream rubbing roller.

<Liquid Developer>

The liquid developer includes the electrically insulating carrier liquid C and the colored particles P dispersed in the carrier liquid C. This liquid developer also contains the polymer compounds R. The liquid developer preferably has a viscosity of 30 to 400 mPa·s at a measurement temperature of 25° C. The viscosity of the liquid developer (at the measurement temperature of 25° C.) is preferably 40 to 300 mPa·s, and more preferably 50 to 250 mPa·s.

<Carrier Liquid>

The electrically insulating carrier liquid C which generally works as liquid carrier enhances electrical insulation of the liquid developer. For example, electrically insulating organic solvent having a volume resistivity of 1012 Ω·cm or above at 25° C. (i.e., an electrical conductivity of 1.0 pS/cm or lower) is preferably used as the electrically insulating carrier liquid C. In addition, carrier liquid, which may further dissolve the polymer compounds R described hereinafter, is preferably used (the one with relatively high solubility for the polymer compounds R).

The viscosity and type of the carrier liquid C as well as the compounding amount therein are appropriately adjusted and selected in order to obtain the 30 to 400 mPa·s viscosity (at the measuring temperature of 25° C.) in the entire liquid developer. The viscosity of the liquid developer depends on a combination of the organic solvent used as the carrier liquid C and the organic polymer compounds R, which is described hereinafter. Therefore, the type and compounding amount of the organic solvent are appropriately determined in response to a desired viscosity of the liquid developer and the selected type of polymer compounds R.

Aliphatic hydrocarbons and vegetable oil, which are liquid at an ordinary temperature, are exemplified the electrically insulating organic solvent.

Liquid n-paraffinic hydrocarbons, iso-paraffinic hydrocarbons, halogenated aliphatic hydrocarbons, branched aliphatic hydrocarbons, and a mixture thereof are exemplified as the aliphatic hydrocarbons. For example, n-hexane, n-heptane, n-octane, nonane, decane, dodecane, hexadecane, heptadecane, cyclohexane, perchloroethylene, trichloroethane, and alike may be used as the aliphatic hydrocarbons. Nonvolatile organic solvent and organic solvent of relatively low volatility (with, for example, a boiling point of 200° C. or higher) are preferred from the perspective of environmental responsiveness (VOC measures). In addition, liquid paraffins which include a relatively large amount of aliphatic hydrocarbon with 16 or more carbon atoms may be preferably used.

Tall oil fatty acid (major components: oleic acid, linoleic acid), vegetable oil-based fatty acid ester, soybean oil, sunflower oil, castor oil, flaxseed oil, and tung oil are exemplified as the vegetable oil. The tall oil fatty acid and alike among them are preferably used.

Liquid paraffins "Moresco White P-55," "Moresco White P-40," "Moresco White P-70," and "Moresco White P-200" manufactured by Matsumura Oil Co., Ltd.; tall oil fatty acids "Hartall FA-1," "Hartall FA-1P," and "Hartall FA-3" manufactured by Harima Chemicals, Inc.; vegetable oil-based solvents "Vege-Sol™ MT," "Vege-Sol™ CM," "Vege-Sol™ MB," "Vege-Sol™ PR," and tung oil manufactured by Kaneda Co., Ltd.; "Isopar™ G," "Isopar™ H," "Isopar™ K," "Isopar™ L," "Isopar™ M," and "Isopar™ V" manufactured by ExxonMobil Corporation; liquid paraffins "Cosmo White P-60," "Cosmo White P-70," and "Cosmo White P-120" manufactured by Cosmo Oil Co., Ltd.; vegetable oils "refined soybean oil S," "flaxseed oil," and "sunflower oil" manufactured by The Nisshin Oillio Group, Ltd.; and "castor oil LAV" and "castor oil I" manufactured by Ito Oil Chemicals Co., Ltd. are exemplified as the carrier liquid C.

In the present embodiment, any carrier liquid C may be used as long as it dissolves the polymer compounds R. In other words, the one with relatively high solubility for the polymer compounds R (the one which dissolves the polymer compounds R successfully) may be used alone as the carrier liquid C, or it may be combined with the one with relatively low solubility for the polymer compounds R (the one that poorly dissolves the polymer compounds R). It should be noted that the electrical conductivity of the entire carrier liquid C (the electrical conductivity of the liquid developer) is adjusted according to types of the carrier liquid C so that the electrical conductivity of the liquid developer does not becomes excessively high. For instance, vegetable oils such as tall oil fatty acids generally have higher electrical conductivities than the aliphatic hydrocarbons such as liquid paraffins. Therefore, if the aforementioned vegetable oils are included as the carrier liquid C in order to successfully dissolve the polymer compounds R in the carrier liquid C, the electrical conductivities should be carefully adjusted.

Carrier liquid C which has a greater amount of the aforementioned oil is more advantageous in terms of the solubility for the polymer compounds R whereas it may be disadvantageous in terms of the electrical conductivity. Carrier liquid C which has a less amount of the aforementioned oil is more advantageous in terms of the electrical conductivity whereas it may be disadvantageous in terms of the solubility for the polymer compounds R.

As described above, the content of the aforementioned oils in the entire carrier liquid C depends on the type and content of the polymer compounds R contained in the liquid developer, and is preferably, for example, 2 to 80 mass %, and more preferably 5 to 60 mass %. It becomes difficult to successfully dissolve the polymer compounds R in the carrier liquid C if the content of the oils is less than 2 mass %. The electrical conductivities of the entire carrier liquid C and the liquid developer become excessively high if the content of the oils exceeds 80 mass %. Excessively high electrical conductivity of the liquid developer leads to low image density.

In the present embodiment, the electrical conductivity of the liquid developer is preferably, for example, 200 pS/cm or lower. Therefore, the electrical conductivity of the entire carrier liquid C (the electrical conductivity of the liquid developer) is preferably adjusted to, for example, 200 pS/cm or lower by mixing a highly electrically resistant aliphatic hydrocarbon with resultant solution from dissolving the polymer compounds R in the oils such as tall oil fatty acids (often referred to as "resin solvent" hereinafter).

<Colored Particles>

Pigment itself may be used as the colored particles P in the present embodiment. The liquid developer containing pigment may perform the non-thermal fixation process described in the context of FIGS. 1A to 10. As a result, the pigment serving as the colored particles P are fixed onto a recording medium without consuming much thermal energy or optical energy. The colored particles P used in the aforementioned image forming unit 341M have a magenta hue. The colored particles P used in the aforementioned image forming unit 341C has a cyan hue. The colored particles P used in the aforementioned image forming unit 341Y has a yellow hue. The colored particles P used in the aforementioned image forming unit 341Bk has a black hue. In the present embodiment, the colored particles P used for forming the image, which is exemplified as the first image, are exemplified as the first colored particles. The colored particles P used for forming the image, which is exemplified as the second image, are exemplified as the second colored particles.

For example, known organic or inorganic pigment may be used for the pigment according to the present embodiment in non-limiting manner.

For example, conventionally known organic pigment or inorganic pigment may be used as the pigments of the present embodiment without any limitation. Azine dyes such as carbon black, oil furnace black, channel black, lampblack, acetylene black, and aniline black, metal salt azo dyes, metallic oxides, and combined metal oxides are exemplified as black pigment. Cadmium yellow, mineral fast yellow, nickel titanium yellow, navels yellow, naphthol yellow S, hansa yellow G, hansa yellow 10G, benzidine yellow GR, quinoline yellow lake, permanent yellow NCG, and tartrazine lake are exemplified as yellow pigment. Molybdenum orange, permanent orange GTR, pyrazolone orange, Vulcan orange, indanthrene brilliant orange RK, benzidine orange G, and indanthrene brilliant orange GK are exemplified as orange pigment. Colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B are exemplified as red pigment. Fast violet B and methyl violet lake are exemplified as purple pigment. C.I. Pigment Blue 15:3, cobalt blue, alkali blue, Victoria blue lake, phthalocyanine blue, non-metal phthalocyanine blue, partial chloride of phthalocyanine blue, fast sky blue, and indanthrene blue BC are exemplified as blue pigment. Chrome green, chromium oxide, pigment green B, and malachite green lake are exemplified as green pigment.

The content of each pigment in the liquid developer is preferably 1 to 30 mass %, more preferably 3 mass % or more, and more preferably 5 mass % or more. The content of each pigment is also more preferably 20 mass % or less, and more preferably 10 mass % or less.

An average particle diameter of each pigment in the liquid developer, which is a volume basis median diameter (D50), is preferably 0.1 to 1.0 μm. The average particle diameter less than 0.1 μm leads to, for example, low image density. The average particle diameter above 1.0 μm leads to, for example, low fixation properties. The volume basis median diameter (D50) here generally denotes a particle diameter at the point where a cumulative curve based on the total volume 100% of one group of particles with a determined particle distribution attains 50%.

<Dispersion Stabilizer>

The liquid developer according to the present embodiment may contain dispersion stabilizer for facilitating and stabilizing dispersion of the particles in the liquid developer. Dispersion stabilizer "BYK-116" manufactured by BYK Co., Ltd., for example, may be suitably used as the dispersion stabilizer according to the present embodiment. In addition, "Solsperse 9000," "Solsperse 11200," "Solsperse 13940," "Solsperse 16000," "Solsperse 17000, and "Solsperse 18000" manufactured by The Lubrizol Corporation, and "Antaron™ V-216" and "Antaron™ V-220" manufactured by International Specialty Products, Inc. may be preferably used.

The content of the dispersion stabilizer in the liquid developer is approximately 1 to 10 mass %, and preferably approximately 2 to 6 mass %.

<Polymer Compounds>

The polymer compounds R contained in the liquid developer according to the present embodiment are organic polymer compounds such as cyclic olefin copolymer, styrene elastomer, cellulose ether and polyvinyl butyral. A material which increases viscosity of the liquid developer to prevent bleeding during the image formation may be selected as the organic polymer compounds with high solubility for the carrier liquid C. A cyclic olefin copolymer, styrene elastomer, cellulose ether, and polyvinyl butyral are exemplified as the organic polymer compounds. Preferably, styrene elastomer is used as the organic polymer compounds. A single type of organic polymer compound or several types of organic polymer compounds may be used as the polymer compounds R.

The liquid developer of the present embodiment contains the polymer compounds dissolved in the carrier liquid C. The organic polymer compounds dissolved in the carrier liquid C may be gel-like polymer compounds. Depending on the types and molecular weights of the organic polymer compounds, the organic polymer compounds are mutually entwined in the carrier liquid C and form gel. The gel-like organic polymer compounds have a relatively low fluidity. For example, if concentration of the organic polymer compounds is high or if affinity of the organic polymer compounds for the carrier liquid C is low or if the ambient temperature is low, the organic polymer compounds are likely to form gel. On the other hand, if the organic polymer compounds hardly entwine mutually in the carrier liquid C, solution with a relatively fluidity is obtained.

The content of the organic polymer compounds in the liquid developer is appropriately determined according to the type of the organic polymer compounds. The content of the organic polymer compounds is preferably, for example, 1 to 10 mass %.

If the content of the polymer compounds is less than 1 mass %, sufficient viscosity may not be obtained in the liquid developer, which may ineffectively prevent bleeding during the image formation. The content of the polymer compounds exceeding 10 mass % leads to formation of an excessively thick film of the organic polymer compounds on the surface of the sheet S, which significantly deteriorates drying characteristics of the film, increases the adherence (tackiness) of the film, and worsens scratch resistance of the image.

The organic polymer compounds which may be preferably used in the present embodiment are described hereinafter in more detail.

(Cyclic Olefin Copolymer)

Cyclic olefin copolymer is amorphous, thermoplastic cyclic olefin resin which has a cyclic olefin skeleton in its main chain without environmental load substance and is excellent in transparency, lightweight properties, and low water absorption properties. The cyclic olefin copolymer of the present embodiment is an organic polymer compound with a main chain composed of a carbon-carbon bond, in which at least a part of the main chain has a cyclic hydrocarbon structure. The cyclic hydrocarbon structure is introduced by using, as a monomer, a compound having at least one olefinic double bond in the cyclic hydrocarbon structure (cyclic olefin), such as norbornene and tetracyclododecene.

Examples of the cyclic olefin copolymer that may be used in the present embodiment include (1) cyclic olefin-based addition (co) polymer or its hydrogenated product, (2) an addition copolymer of a cyclic olefin and an α-olefin, or its hydrogenated product, and (3) a cyclic olefin-based ring-opening (co) polymer or its hydrogenated product.

Specific examples of the cyclic olefin copolymer are as follows:

(a) Cyclopentene, cyclohexane, cyclooctene;

(b) Cyclopentadiene, 1,3-cyclohexadiene and other one-ring cyclic olefins;

(c) Bicyclo [2.2.1] hept-2-ene (norbornene), 5-methyl-bicyclo [2.2.1] hept-2-ene, 5,5-dimethyl-bicyclo [2.2.1] hept-2-ene, 5-ethyl-bicyclo [2.2.1] hept-2-ene, 5-butyl-bicyclo [2.2.1] hept-2-ene, 5-ethylidene-bicyclo [2.2.1] hept-2-ene, 5-hexyl-bicylo [2.2.1] hept-2-ene, 5-octyl-bicyclo [2.2.1] hept-2-ene, 5-octadecyl-bicylo [2.2.1] hept-2-ene, 5-methylidene-bicyclo [2.2.1] hept-2-ene, 5-vinyl-bicyclo [2.2.1] hept-2-ene, 5-propenyl-bicyclo [2.2.1] hept-2-ene, and other two-ring cyclic olefins;

(d) Tricyclo [4.3.0.12,5] deca-3,7-diene (dicyclopentadiene), tricyclo [4.3.0.12,5] deca-3-ene;

(e) Tricyclo [4.4.0.12,5] undeca-3,7-diene or tricyclo [4.4.0.12,5] undeca-3,8-diene or tricyclo [4.4.0.12,5] undeca-3-ene that is a partially hydrogenated product (or an adduct of cyclopentadiene and cyclohexane) thereof;

(f) 5-cyclopentyl bicyclo [2.2.1] hept-2-ene, 5-cyclohexyl-bicyclo [2.2.1] hept-2-ene, 5-cyclohexenyl bicyclo [2.2.1] hept-2-ene, 5-phenyl-bicyclo [2.2.1] hept-2-ene, and other three-ring cyclic olefins;

(g) Tetracyclo [4.4.0.12,5.17,10] dodeca-3-ene (tetracyclododecene), 8-methyltetracyclo [4.4.0.12,5.17,10] dodeca-3-ene, 8-ethyltetracyclo [4.4.0.12,5.17,10] dedeca-3-ene, 8-methylidenetetracyclo [4.4.0.12,5.17,10] dodeca-3-ene, 8-ethylidenetetracyclo [4.4.0.12,5.17,10] dodeca-3-ene, 8-vinyltetracyclo [4.4.0.12,5.17,10] dodeca-3-ene, 8-propenyl-tetracyclo [4.4.0.12,5.17,10] dodeca-3-ene, and other four-ring cyclic olefins;

(h) 8-cyclopentyl-tetracyclo [4.4.0.12,5.17,10] dodeca-3-ene, 8-cyclohexyl-tetracyclo [4.4.0.12,5.17,10] dodeca-3-ene, 8-cyclohexenyl-tetracyclo [4.4.0.12,5.17,10] dodeca-3-ene, and 8-phenyl-cyclopentyl-tetracyclo [4.4.0.12,5.17,10] dodeca-3-ene;

(i) Tetracyclo [7.4.13,6.01,9.02,7] tetradeca-4,9,11,13-tetraene (1,4-methano-1,4,4a,9a-tetrahydrofluorene), tetracyclo [8.4.14,7.01,10.03,8] pentadeca-5,10,12,14-tetraene (1,4-methano-1,4,4a,5,10,10a-hexahydroanthracene);

(j) Pentacyclo [6.6.1.13,6.02,7.09,14]-4-hexadecene, pentacyclo [6.5.1.13, 6.02,7.09,13]-4-pentadecene, pentacyclo [7.4.0.02,7.13,6.110,13]-4-pentadecene, heptacyclo [8.7.0.12,9.14,7.111,17.03,8.012,16]-5-eicosene, heptacyclo [8.7.0.12,9.03,8.14,7.012,17.113,16]-14-eicosene; and (k) Polycyclic olefins such as tetramers of cyclopentadiene. These cyclic olefins may be used alone or in combinations of two or more thereof.

An α-olefin having 2 to 20 carbon atoms, and preferably 2 to 8 carbon atoms is preferable for the abovementioned α-olefin. Specific examples thereof include ethylene, propylene, 1-butene, 1-pentene, 1-hexene, 3-methyl-1-butene, 3-methyl-1-pentene, 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, and 1-eicosene. These α-olefins may be used alone or in combinations of two or more thereof.

In the present embodiment, a method for polymerizing cyclic olefins, a method for polymerizing cyclic olefins with α-olefins, and a method for hydrogenating the resultant polymer are not particularly limited and may be carried out according to well-known methods.

In the present embodiment, the structure of the cyclic olefin copolymer is not particularly limited and may be linear, branched or crosslinked. In the present embodiment, the cyclic olefin copolymer is preferably linear.

In the present embodiment, a copolymer of norbornene and ethylene, or of tetracyclododecene and ethylene may be preferably used as the cyclic olefin copolymer, and the copolymer of norbornene and ethylene is more preferred. In this case, the content of norbornene in the copolymer is preferably 60 to 82 mass %, more preferably 60 to 79 mass %, yet more preferably 60 to 76 mass %, and most preferably 60 to 65 mass %. If the content of norbornene is less than 60 mass %, glass transition temperature of the cyclic olefin copolymer film may become excessively low, which may lead to a risk of lowering film formation properties of the cyclic olefin copolymer. If the content of norbornene exceeds 82 mass %, glass transition temperature of the cyclic olefin copolymer film may become excessively high, which may lead to a risk of lowering fixation properties of the pigments, that is, fixation properties of images by the film of the cyclic olefin copolymer. Or the solubility of the cyclic olefin copolymer for the carrier liquid C may also be reduced.

In the present embodiment, a commercially available cyclic olefin copolymer may be used. Examples of the copolymer of norbornene and ethylene include "TOPAS™ TM" (norbornene content: approximately 60 mass %), "TOPAST™ TB" (norbornene content: approximately 60 mass %), "TOPAST™ 8007" (norbornene content: approximately 65 mass %), "TOPAST™ 5013" (norbornene content: approximately 76 mass %), "TOPAST™ 6013" (norbornene content: approximately 76 mass %), "TOPAS™ 6015" (norbornene content: approximately 79 mass %), and "TOPAST™ 6017" (norbornene content: approximately 82 mass %), which are manufactured by TOPAS Advanced Polymers GmbH. These copolymers may be used alone or in combinations of two or more thereof, depending on the circumstances.

(Styrene Elastomer)

A conventionally known styrene elastomer may be used as the styrene elastomer available in the present embodiment. Specific examples thereof include a block copolymer composed of an aromatic vinyl compound and a conjugated diene compound or olefinic compound. Examples of the block copolymer include a block copolymer that has a structure expressed by Chemical Formula 1 where A is a polymer block composed of an aromatic vinyl compound and B is a polymer block composed of an olefinic compound or a conjugated diene compound.

[C 1]

(Chemical Formula 1)

$$[A-B]_x-A$$

(Where x represents an integer chosen such that the number molecular average weight ranges from 1,000 to 100,000.)

Examples of the aromatic vinyl compound constituting the block copolymer include styrene, α-methylstyrene, o-methylstyrene, m-methylstyrene, p-methylstyrene, 2,3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, and vinylanthracene.

The polymer block A may be composed of one or two or more types of the aforementioned aromatic vinyl compounds. The one composed of styrene and/or α-methylstyrene among these aromatic vinyl compounds provides suitable properties for the liquid developer of the present embodiment.

Examples of the olefinic compound constituting the block copolymer include ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, and vinylcyclooctene.

Examples of the conjugated diene compound constituting the block copolymer include butadiene, isoprene, chloroprene, 2,3-dimethyl-1,3-butadiene, 1,3-pentadien, and 1,3-hexadien.

The polymer block B may be composed of one or two or more types of each of the olefinic compounds and the conjugated diene compounds. The one composed of butadiene and/or isoprene among these compounds provides suitable properties for the liquid developer of the present embodiment.

Specific examples of the block copolymer include a polystyrene-polybutadiene-polystyrene triblock copolymer or its hydrogenated product, polystyrene-polyisoprene-polystyrene triblock copolymer or its hydrogenated product, polystyrene-poly (isoprene/butadiene)-polystyrene triblock copolymer or its hydrogenated product, poly (α-methylstyrene)-polybutadiene-poly (α-methylstyrene) triblock copolymer or its hydrogenated product, poly (α-methylstyrene)-polyisoprene-poly (α-methylstyrene) triblock copolymer or its hydrogenated product, poly α-methylstyrene)-poly (isoprene/butadiene)-poly (α-methylstyrene) triblock copolymer or its hydrogenated product, polystyrene-polyisobutene-polystyrene triblock copolymer, and poly α-methylstyrene)-polyisobutene-poly (α-methylstyrene) triblock copolymer.

As the styrene elastomer which may be used in the present embodiment, it is preferred to use a styrene-butadiene elastomer (SBS) that has a structure in which the polymer block A and polymer block B are expressed by Chemical Formula 2.

[C 2]

(Chemical Formula 2)

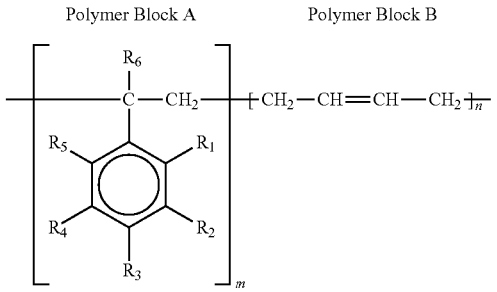

(where $R_1$, $R_2$, $R_4$, $R_5$ and $R_6$ each represent a hydrogen atom or methyl group; $R_3$ represents a hydrogen atom, a halogen atom, a phenyl group or a saturated alkyl group, a methoxy group or ethoxy group having 1 to 20 carbon atoms; and m, n each represent an integer chosen such that the content of the polymer block A ranges from 5 to 75 mass %.)

The styrene-butadiene elastomer is obtained by copolymerizing styrene monomer and butadiene, which is the conjugated diene compound. Examples of preferred styrene monomer include styrene, α-methylstyrene, o-methylstyrene, m-methylstyrene, p-methylstirene, p-ethylstyrene, 2,4-dimethylstyrene, p-n-butylstyrene, p-dodecylstyene, p-methoxystyrene, p-phenylstyrene, and p-chlorostyrene.

The styrene-butadiene elastomer has a number average molecular weight Mn in a range of, preferably, 1,000 to 100,000 (see Chemical Formula 1) and more preferably 2,000 to 50,000, in a molecular weight distribution measured by means of a GPC (gel permeation chromatography). A weight-average molecular weight Mw of the styrene-butadiene elastomer is in a range of, preferably, 5,000 to 1,000,000 and more preferably 10,000 to 500,000. In this case, at least one peak is present in the weight-average molecular weight Mw range of 2,000 to 200,000 and preferably in the weight-average molecular weight Mw range of 3,000 to 150,000.

In the styrene-butadiene elastomer, the value of ratio (weight-average molecular weight Mw/number average molecular weight Mn) is preferably equal to or lower than 3.0, and more preferably equal to or lower than 2.0.

The content of styrene in the styrene-butadiene elastomer (the content of the polymer block A) is in a range of, preferably, 5 to 75 mass % (see Chemical Formula 2) and more preferably 10 to 65 mass %. If the styrene content is less than 5 mass %, glass transition temperature of the styrene elastomer film becomes excessively low and deteriorates the film formation properties of the styrene elastomer. If the styrene content exceeds 75 mass %, a softening point of the styrene elastomer film becomes excessively high and worsens fixation properties of the pigments, that is, fixation properties of images by the styrene elastomer film.

In the present embodiment, a commercially available styrene elastomer may be used. For example, "Klayton" manufactured by Shell, "Asaprene™" T411, T413, T437, "Tufprene™" A, 315P, which are manufactured by Asahi Kasei Chemicals Corporation, and "JSR TR1086," "JSR TR2000," "JSR TR2250" and "JSR TR2827" manufactured by JSR Corporation, may be used as a styrene-conjugated diene block copolymer. "Septon" S1001, S2063, S4055, S8007, "Hybrar" 5127, 7311, which are manufactured by Kuraray Co., Ltd., "Dynaron" 6200P, 4600P, 1320P manufactured by JSR Corporation may be used as a hydrogenated product of the styrene-conjugated diene block copolymer. Also, "Index"

manufactured by The Dow Chemical Company may be used as styrene-ethylene copolymer. As other styrene elastomers, "Aron AR" manufactured by Aronkasei Co., Ltd. and "Rabalon" manufactured by Mitsubishi Chemical Corporation may be used. These materials may be used alone or in combinations of two or more types thereof.

(Cellulose Ether)

Cellulose ether is a polymer formed by substituting a hydroxyl group of a cellulose molecule with an alkoxy group. The substitution rate is preferably 45 to 49.5%. The alkyl moiety of the alkoxy group may be substituted with, for example, hydroxyl group or alike. A film formed by cellulose ether is excellent in toughness and thermal stability.

Examples of the cellulose ether which may be used in the present embodiment include: alkyl cellulose such as methylcellulose and ethylcellulose; hydroxyalkyl cellulose such as hydroxyethyl cellulose and hydroxypropyl cellulose; hydroxy alkyl alkyl cellulose such as hydroxyethyl methyl cellulose, hydroxypropyl methyl cellulose, and hydroxyethyl ethyl cellulose; carboxy alkyl cellulose such as carboxymethyl cellulose; and carboxy-alkyl hydroxy-alkyl cellulose such as carboxymethyl hydroxyethyl cellulose. These cellulose ethers may be used alone or in combinations of two or more thereof. Alkyl celluloses are preferred among these cellulose ethers. Ethyl celluloses are preferred among these alkyl celluloses.

In the present embodiment, a commercially available cellulose ether may be used. Examples of ethylcellulose include "Ethocel™ STD4," "Ethocel™ STD7," and "Ethocel™ STD10" manufactured by Nissin-Kasei Co., Ltd. These ethyl celluloses may be used alone or in combinations of two or more thereof, depending on the circumstances.

(Polyvinyl Butyral)

The polyvinyl butyral which may be used in the present embodiment (butyral resin: alkyl acetalized polyvinyl alcohol) is, as shown in Chemical Formula 3, a copolymer of a hydrophilic vinyl alcohol unit having a hydroxyl group, a hydrophobic vinyl acetal unit having a butyral group, and a vinyl acetate unit having an intermediate property between a vinyl alcohol unit and vinyl acetal unit and having an acetyl group. Polyvinyl butyral which has a degree of butyralization (the ratio between a hydrophilic moiety and a hydrophobic moiety) between 60 to 85 mol % is preferred in the liquid developer of the present embodiment in terms of its excellent film formation properties (film formation properties). The polyvinyl butyral has a vinyl acetal unit indicating the solubility of the polyvinyl butyral for nonpolar solvent and a vinyl alcohol unit for improving the bonding properties of the recording medium such as a paper sheet. Therefore, the polyvinyl butyral has high affinity with both the carrier liquid C and the recording medium.

[C 3] (Chemical Formula 3)

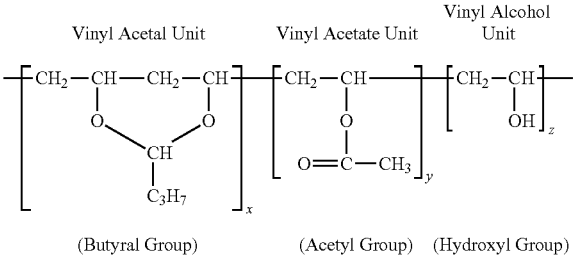

The polyvinyl butyral which may be used in the present embodiment is not particularly limited. Examples thereof include Mowital™ B20H, B30B, B30H, B60T, B60H, B60HH and B70H manufactured by Hoechst AG; "S-LEC™" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %) and BM-S, manufactured by Sekisui Chemical Co., Ltd.; and "Denka butyral" #2000-L, #3000-1, #3000-2, #3000-3, #3000-4, #3000-K, #4000-1, #5000-A, and #6000-C manufactured by Denki Kagaku Kogyo KK. These polyvinyl butyrals may be used alone or in combinations of two or more thereof.

(Manufacturing Method)

The liquid developer according to the present embodiment may be produced by sufficiently dissolving or mixing/dispersing the carrier liquid C, pigments, polymer compounds and optionally the dispersion stabilizer for several minutes to over 10 hours, as appropriate, by using, for example, a ball mill, sand grinder, Dyno mill, rocking mill or alike (or a media distributed machine using zirconia beads and alike may be used).

Mixing/dispersing these components pulverize the pigments into fine pieces. The mixing/dispersion time and the rotating speed of the machine are adjusted so that the average particle diameter ($D_{50}$) of the pigments in the liquid developer becomes, preferably, 0.1 to 1.0 μm as described above. If the dispersion time is excessively short or if the rotating speed is excessively low, the average particle diameter of the pigments ($D_{50}$) exceeds 1.0 μm, and deteriorates the fixation properties as described above. If the dispersion time is excessively long or if the rotating speed is excessively high, the average particle diameter of the pigments ($D_{50}$) becomes less than 0.1 μm, which in turn leads to poor developing properties and low image density.

In the present embodiment, the liquid developer may be produced by dissolving the polymer compounds in the carrier liquid C and then mixing/dispersing the pigments (along with the dispersion stabilizer, as appropriate). The liquid developer may also be produced by preparing solution obtained by dissolving the polymer compounds in the carrier liquid C and a pigment dispersion (obtained by mixing/dispersing the pigments in the carrier liquid C (along with the dispersion stabilizer, as appropriate)), and then mixing the resin solution with the pigment dispersion at an appropriate mixing ratio (mass ratio).

A particle size distribution needs to be measured in order to calculate the average particle diameter (D50) of the pigments. The particle size distribution of the pigments may be measured as follows.

A given amount of produced liquid developer or prepared pigment dispersion is sampled and diluted to 10 to 100 times of its volume with the same carrier liquid C as the one used in the liquid developer or the pigment dispersion. The particle size distribution of thus obtained liquid is measured on the basis of a flow system using a laser diffraction type particle size distribution measuring device "Mastersizer 2000" manufactured by Malvern Instruments Ltd.

The viscosity of the produced liquid developer may be measured at a measurement temperature of 25° C. by using a vibrational viscometer "Viscomate VM-10A-L" manufactured by CBC Co., Ltd.

(Second Embodiment)

Figure 11:
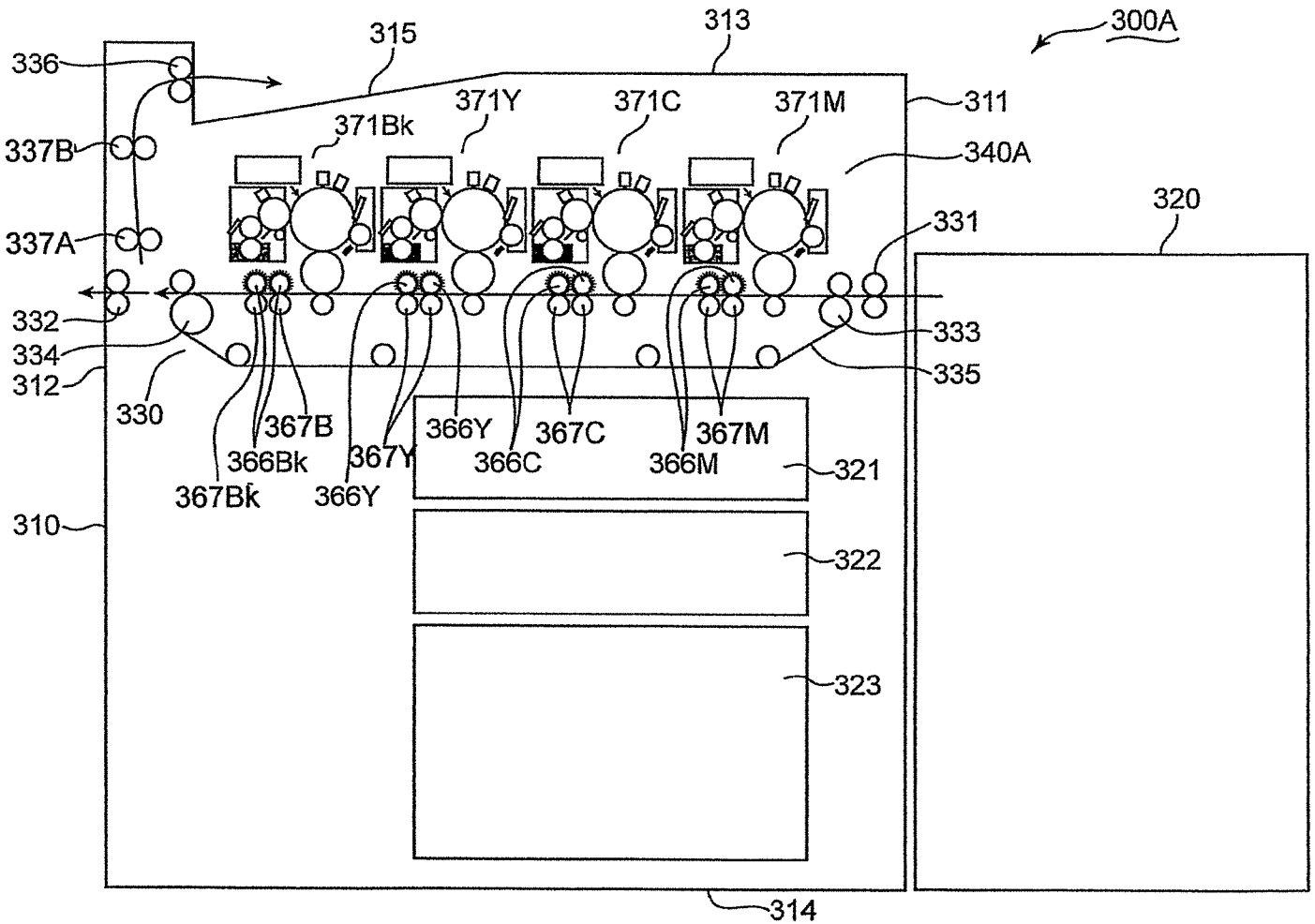
FIG. 11 is a schematic view of a color printer exemplified as an image forming apparatus according to the second embodiment.

FIG. 11 is a schematic view of a color printer exemplified as an image forming apparatus according to the second embodiment. The color printer is described with reference to FIGS. 5 and 11. The same reference numerals are applied to the same elements as those of the color printer 300 according to the first embodiment. The descriptions of the first embodiment are incorporated hereinafter to describe these same elements.

A color printer 300A according to the present embodiment has an image forming portion 340A, which uses the liquid developer to form an image on a sheet. The image forming portion 340A includes an image forming unit 371M, which forms a magenta image, an image forming unit 371C, which forms a cyan image, an image forming unit 371Y, which forms a yellow image, and an image forming unit 371Bk, which forms a black image. The image forming units 371M, 371C, 371Y and 371Bk are arranged in a direction from the right roller 333 to the left roller 334, like the image forming units 341M, 341C, 341Y and 341Bk described in the context of the first embodiment.

The image forming units 371M, 371C, 371Y and 371Bk have additional rubbing rollers 366M, 366C, 366Y and 366Bk, respectively, in addition to the various elements included in the image forming units 341M, 341C, 341Y and 341Bk described in the context of the first embodiment. Therefore, the image forming units 371M, 371C, 371Y and 371Bk include the paired rubbing rollers 366M, 366C, 366Y and 366Bk, respectively. The image forming unit 371M has the holding rollers 367M, which correspond to the two rubbing rollers 366M, respectively. The image forming unit 3710 has the holding rollers 367C, which correspond to the two rubbing rollers 366C, respectively. The image forming unit 371Y has the holding rollers 367Y, which correspond to the two rubbing rollers 366Y, respectively. The image forming unit 371Bk has the holding rollers 367Bk, which correspond to the two rubbing rollers 366Bk, respectively.

The increase in the rubbing rollers 366M, 366C, 366Y and 366Bk leads to an increase in a rubbing amount for the image on the sheet. Therefore, the color printer 300A may appropriately fix the image onto the sheet.

In the present embodiment, each of the image forming units 371M, 371C, 371Y and 371Bk has the rubbing rollers 366M, 366C, 366Y and 366Bk. Alternatively, some of the image forming units may have a single rubbing roller. As long as at least one of the image forming units has a few rubbing rollers, the principles of the present embodiment are used to appropriately fix the image onto the sheet.

(Third Embodiment)

Figure 12:
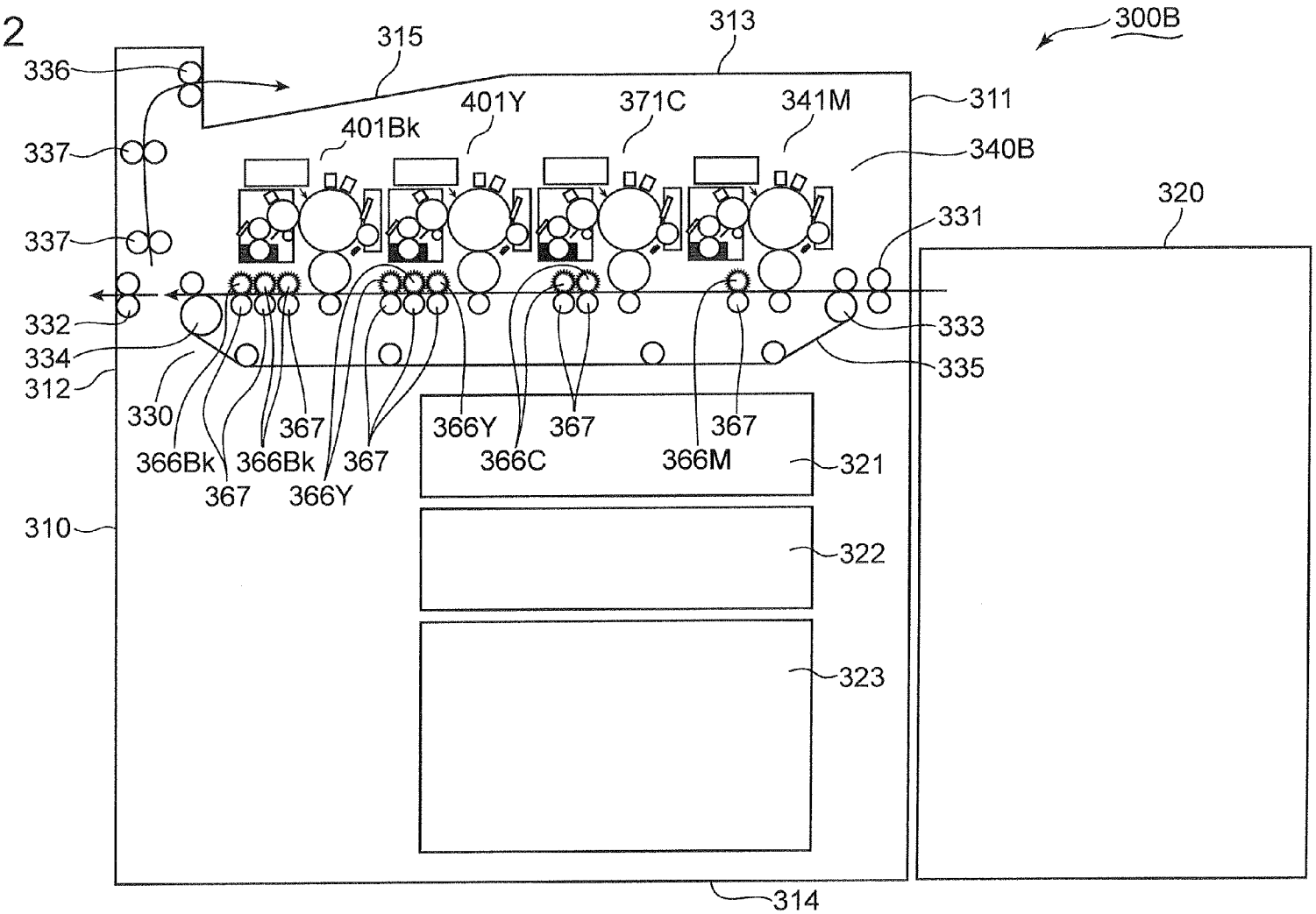
FIG. 12 is a schematic view of a color printer exemplified as an image forming apparatus according to the third embodiment.

FIG. 12 is a schematic view of a color printer exemplified as an image forming apparatus according to the third embodiment. The color printer is described with reference to FIGS. 5, 11 and 12. The same reference numerals are applied to the same elements as those of the color printer 300 of the first embodiment and/or the color printer 300A of the second embodiment. The descriptions of the first and/or second embodiments are incorporated hereinafter to describe these same elements.

A color printer 300B according to the present embodiment has an image forming portion 340B, which uses the liquid developer to form an image on a sheet. The image forming portion 340B includes an image forming unit 401Y, which forms a yellow image, and an image forming unit 401Bk, which forms a black image, in addition to the image forming unit 341M described in the context of the first embodiment and the image forming unit 371C described in the context of the second embodiment. The image forming units 341M, 371C, 401Y and 401Bk are arranged in a direction from the right roller 333 to the left roller 334, like the image forming units 341M, 341C, 341Y and 341Bk described in the context of the first embodiment.

The image forming units 401Y and 401Bk have additional rubbing rollers 366Y and 366Bk, respectively, in addition to the various elements included in the image forming units 371Y and 371Bk described in the context of the second embodiment. Therefore, the image forming units 401Y and 401Bk include three rubbing rollers 366Y and 366Bk, respectively. The image forming unit 401Y has the holding rollers 367, which correspond to the three rubbing rollers 366Y, respectively. The image forming unit 401Bk has the holding rollers 367, which correspond to the three rubbing rollers 366Bk, respectively.

A number of the rubbing rollers 366C of the image forming unit 371C is greater than a number of the rubbing rollers 366M of the upstream image forming unit 341M. A number of the rubbing rollers 366Y of the image forming unit 401Y is greater than a number of rubbing rollers 366C of the upstream image forming unit 371C. Because a rubbing amount increases as a liquid developer amount on the sheet increases, the color printer 300B may appropriately fix the image onto the sheet.

(Fourth Embodiment)

Figure 13:
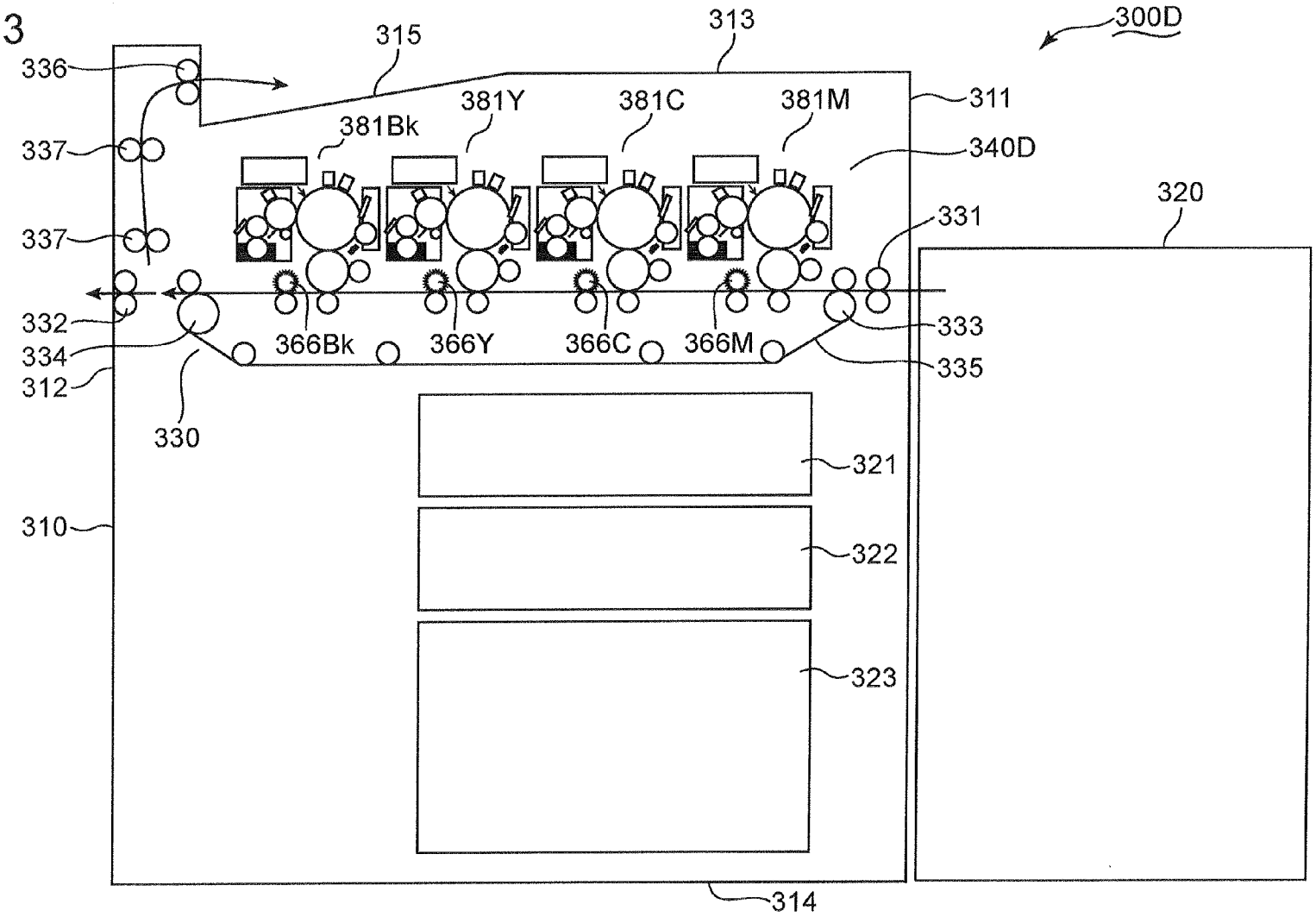
FIG. 13 is a schematic view of a color printer exemplified as an image forming apparatus according to the fourth embodiment.

FIG. 13 is a schematic view of a color printer exemplified as an image forming apparatus according to the fourth embodiment. The color printer is described with reference to FIGS. 5 and 13. The same reference numerals are applied to the same elements as those of the color printer 300 according to the first embodiment. The descriptions of the first embodiment are incorporated hereinafter to describe these same elements.

A color printer 300D according to the present embodiment has an image forming portion 340D, which uses the liquid developer to form an image on a sheet. The image forming portion 340D includes an image forming unit 381M, which forms a magenta image, an image forming unit 381C, which forms a cyan image, an image forming unit 381Y, which forms a yellow image, and an image forming unit 381Bk, which forms a black image. The image forming units 381M, 381C, 381Y and 381Bk are arranged in a direction from the right roller 333 to the left roller 334, like the image forming units 341M, 341C, 341Y and 341Bk described in the context of the first embodiment.

Figure 14:
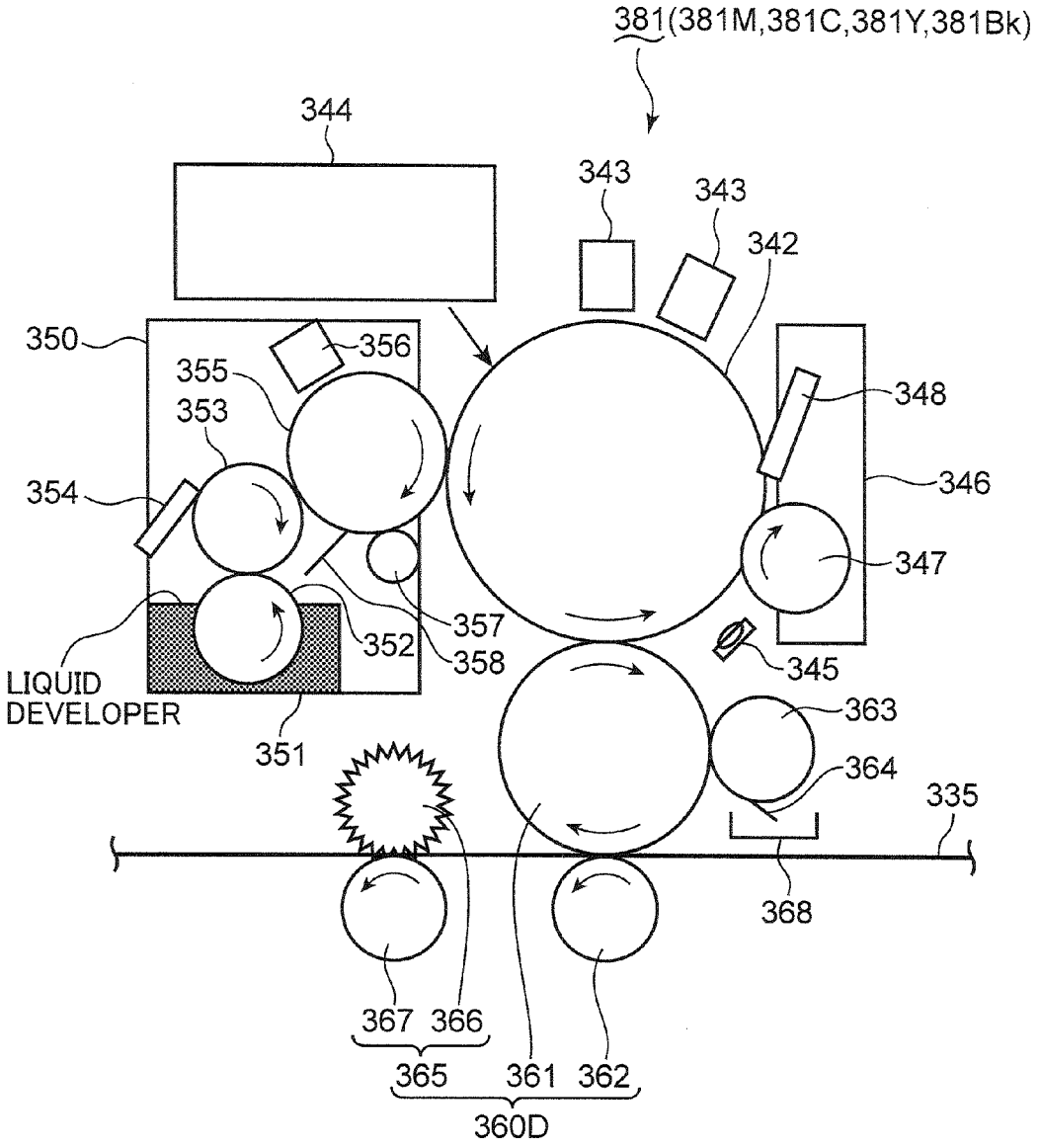
FIG. 14 is a schematic view showing an image forming unit of the color printer shown in FIG. 13.

FIG. 14 is a schematic view showing an image forming unit. The image forming units 381M, 381C, 381Y and 381Bk are described with reference to FIG. 14.

An image forming unit 381 shown in FIG. 14 represents one of the image forming units 381M, 381C, 381Y and 381Bk shown in FIG. 13. Therefore, the description of a structure of the image forming unit 381 shown in FIG. 14 is applied to each of the image forming units 381M, 381C, 381Y, and 381Bk shown in FIG. 13.

The image forming unit 381 has a transfer unit 360D in addition to the photosensitive drum 342, first charger 343, exposure device 344, developing device 350, neutralization device 345, and cleaning device 346, that are the same as those of the image forming unit 341 described in the context of the first embodiment. The transfer unit 360D has a removal roller 363, which removes oil in the carrier liquid from the image on the circumferential surface of the intermediate transfer roller 361, a cleaning blade 364, which has an edge abutting with the circumferential surface of the removal roller 363, and a recovery box 368, which recovers the oil scraped off from the circumferential surface of the removal roller 363 by the cleaning blade 364, in addition to the intermediate transfer roller 361, backup roller 362, and rubbing unit 365, which are the same as those of the transfer unit 360 described in the context of the first embodiment. In the present embodiment, the removal roller 363 is exemplified as the removal element.

While the intermediate transfer roller 361 delivers the image from the photosensitive drum 342 to the sheet on the conveying belt 335, the removal roller 363 appropriately removes the oil in the carrier liquid of the liquid developer, which is used to form the image, from the circumferential surface of the intermediate transfer roller 361 to facilitate the image fixation onto the sheet by means of the rubbing roller 366.

Although the present invention has been fully described by way of example with reference to the accompanying drawings, it should be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a conveyor configured to convey a sheet in a first direction; and an image forming portion that uses liquid developer to form an image on the sheet, wherein the image forming portion includes a first transfer unit that transfers a first image to the sheet, and a second transfer unit that transfers a second image after the first transfer unit, the first transfer unit includes a first rubbing unit configured to rub the first image on the sheet and to achieve fixation of the image on the sheet without use of an external heating device, the second transfer unit includes a second rubbing unit configured to rub the second image on the sheet and to achieve fixation of the image on the sheet without use of an external heating device, the liquid developer includes colored particles for coloring the image, carrier liquid in which the colored particles are dispersed, and polymer compounds dissolved or swollen in the carrier liquid, the colored particles consist of pigment, and the polymer compounds are selected from the group consisting of styrene elastomer, cellulose ether and polyvinyl butyral and cover the colored particles on the sheet.

2. The image forming apparatus according to claim 1, wherein at least one of the first and second rubbing units includes rubbing elements that rub the image.

3. The image forming apparatus according to claim 2, wherein the second rubbing unit includes more rubbing elements than the first rubbing unit.

4. The image forming apparatus according to claim 2, wherein the conveyor conveys the sheet at a first speed, the image forming portion includes a drive mechanism configured to drive the rubbing elements, each of the rubbing elements includes a contact surface that comes into contact with the image on the sheet, and the drive mechanism moves the contact surface in the first direction at a second speed different from the first speed.

5. The image forming apparatus according to claim 2, wherein the image forming portion includes a drive mechanism configured to drive the rubbing elements, each of the rubbing elements includes a contact surface that comes into contact with the image on the sheet, and the drive mechanism moves the contact surface in a second direction different from the first direction.

6. The image forming apparatus according to claim 4, wherein the contact surface is at least partially covered with a non-woven fabric.

7. The image forming apparatus according to claim 4, wherein the contact surface is at least partially provided with a brush.

8. The image forming apparatus according to claim 1, wherein the first rubbing unit includes a first rubbing element that rubs the first image, the second rubbing unit includes a second rubbing element that rubs the second image, the image forming portion includes a drive mechanism configured to drive the first and second rubbing elements, the first rubbing element includes a first contact surface that comes into contact with the first image, the second rubbing element includes a second contact surface that comes into contact with the second image, and the drive mechanism moves the second contact surface faster than the first contact surface.

9. The image forming apparatus according to claim 1, wherein the carrier liquid contains oil, the image forming portion includes an image forming element with a formation surface to which the liquid developer is applied to form the first or second image, and at least one of the first and second transfer units includes:

a relay element that delivers the first or second image from the image forming element to the sheet on the conveyor; and a removal element that removes the oil from the first or second image on the relay element.

10. The image forming apparatus according to claim 1, wherein the colored particles include first colored particles that have a first hue, and second colored particles that have a second hue different from the first hue, the first image is formed by the first colored particles, the second image is formed by the second colored particles, and the second transfer unit superimposes the second image on the first image to form the image on the sheet.

* * * * *